US007909741B2

(12) United States Patent
Kim et al.

(10) Patent No.: US 7,909,741 B2
(45) Date of Patent: Mar. 22, 2011

(54) DEVICES, SYSTEMS AND METHODS FOR RECEIVING, RECORDING AND DISPLAYING INFORMATION RELATING TO PHYSICAL EXERCISE

(75) Inventors: Hidong Kim, Bainbridge Island, WA (US); Daniel Kohn, Cambridge, MA (US)

(73) Assignee: DHKL, Inc., Bainbridge Island, WA (US)

( * ) Notice: Subject to any disclaimer, the term of this patent is extended or adjusted under 35 U.S.C. 154(b) by 512 days.

(21) Appl. No.: 11/692,078

(22) Filed: Mar. 27, 2007

(65) Prior Publication Data

US 2008/0242512 A1 Oct. 2, 2008

(51) Int. Cl.
*A63B 21/00* (2006.01)

(52) U.S. Cl. ..... 482/93; 482/92; 482/107

(58) Field of Classification Search ..... 482/1–9, 482/92–109, 900–902; 434/247
See application file for complete search history.

(56) References Cited

U.S. PATENT DOCUMENTS

| | | | | |
|---|---|---|---|---|
| 4,493,485 | A | | 1/1985 | Jones |
| 4,817,940 | A | | 4/1989 | Shaw et al. |
| 4,869,497 | A | | 9/1989 | Stewart et al. |
| 4,907,795 | A | | 3/1990 | Shaw et al. |
| 5,000,446 | A | | 3/1991 | Sarno |
| 5,037,089 | A | | 8/1991 | Spagnuolo et al. |
| 5,151,071 | A | | 9/1992 | Jain et al. |
| 5,213,555 | A | | 5/1993 | Hood et al. |
| 5,314,394 | A | | 5/1994 | Ronan |
| 5,350,344 | A | * | 9/1994 | Kissel ..... 482/98 |
| 5,374,227 | A | | 12/1994 | Webb |
| 5,462,503 | A | | 10/1995 | Benjamin et al. |
| 5,466,200 | A | | 11/1995 | Ulrich et al. |
| 5,577,981 | A | | 11/1996 | Jarvik |
| 5,598,849 | A | | 2/1997 | Browne et al. |
| 5,655,997 | A | | 8/1997 | Greenberg et al. |
| 5,690,582 | A | | 11/1997 | Ulrich et al. |
| 5,702,323 | A | | 12/1997 | Poulton |
| 5,785,630 | A | | 7/1998 | Bobick et al. |

(Continued)

FOREIGN PATENT DOCUMENTS

WO WO-87/05727 9/1987

OTHER PUBLICATIONS

International Search Report and Written Opinion for PCT/US2007/065328, DHKL, Inc., Feb. 13, 2008, pp. 1-6.

(Continued)

*Primary Examiner* — Glenn Richman
(74) *Attorney, Agent, or Firm* — Perkins Coie LLP

(57) ABSTRACT

Devices, systems and methods for receiving, recording, and/or displaying information related to physical exercise are disclosed herein. In one embodiment, an instrumented weight pin for use with a stacked weight exercise machine includes a shaft portion extending outwardly from a handle portion. In this embodiment, the shaft portion is configured to be removably positioned adjacent to one or more weights of the exercise machine to selectively engage the one or more weights during use of the exercise machine. The weight pin can further include a load sensor and/or an accelerometer. The load sensor and/or the accelerometer can provide information associated with an exercise set to a data storage device carried by the weight pin. The data storage device can be operably coupled to a user computer or other display device so that information relating to the exercise set can be displayed for viewing by the user.

29 Claims, 19 Drawing Sheets

U.S. PATENT DOCUMENTS

| | | | |
|---|---|---|---|
| 5,785,632 | A | 7/1998 | Greenberg et al. |
| 5,890,995 | A | 4/1999 | Bobick et al. |
| 5,890,997 | A | 4/1999 | Roth |
| 5,976,083 | A | 11/1999 | Richardson et al. |
| 5,980,429 | A | 11/1999 | Nashner |
| 5,997,440 | A | 12/1999 | Hanoun et al. |
| 6,014,078 | A | 1/2000 | Rojas et al. |
| 6,050,924 | A | 4/2000 | Shea |
| 6,053,844 | A | 4/2000 | Clem |
| 6,059,692 | A | 5/2000 | Hickman |
| 6,077,193 | A | 6/2000 | Buhler et al. |
| 6,132,337 | A | 10/2000 | Krupka et al. |
| 6,171,218 | B1 | 1/2001 | Shea |
| 6,244,988 | B1 | 6/2001 | Delman |
| 6,368,251 | B1 | 4/2002 | Casler et al. |
| 6,458,060 | B1 | 10/2002 | Watterson et al. |
| 6,494,811 | B1 | 12/2002 | Alessandri et al. |
| 6,497,638 | B1 | 12/2002 | Shea |
| 6,533,709 | B1 | 3/2003 | Jones |
| 6,601,016 | B1 | 7/2003 | Brown et al. |
| 6,605,038 | B1 | 8/2003 | Teller et al. |
| 6,626,800 | B1 | 9/2003 | Casler |
| 6,632,158 | B1 | 10/2003 | Nashner |
| 6,645,124 | B1 | 11/2003 | Clem |
| 6,648,798 | B2 | 11/2003 | Yoo |
| 6,659,913 | B2 | 12/2003 | Johnston et al. |
| 6,669,600 | B2 | 12/2003 | Warner |
| 6,746,371 | B1 | 6/2004 | Brown et al. |
| 6,749,537 | B1 | 6/2004 | Hickman |
| 6,793,607 | B2 | 9/2004 | Neil |
| 6,796,925 | B2 | 9/2004 | Martinez et al. |
| 6,852,069 | B2 | 2/2005 | Park et al. |
| 6,863,641 | B1 | 3/2005 | Brown et al. |
| 6,866,613 | B1 | 3/2005 | Brown et al. |
| 6,949,052 | B2 | 9/2005 | Millington et al. |
| 6,991,586 | B2 | 1/2006 | Lapcevic |
| 6,997,852 | B2 | 2/2006 | Watterson et al. |
| 7,030,735 | B2 | 4/2006 | Chen |
| 7,060,006 | B1 | 6/2006 | Watterson et al. |
| 7,063,643 | B2 | 6/2006 | Arai et al. |
| 7,063,644 | B2 | 6/2006 | Albert et al. |
| 7,070,539 | B2 | 7/2006 | Brown et al. |
| 7,121,982 | B2 | 10/2006 | Feldman |
| 2003/0032529 | A1 | 2/2003 | Alessandri et al. |
| 2003/0069108 | A1 | 4/2003 | Kaiserman et al. |
| 2005/0075213 | A1 | 4/2005 | Arick |
| 2005/0272561 | A1 | 12/2005 | Cammerata |
| 2006/0293151 | A1 | 12/2006 | Rast |

OTHER PUBLICATIONS

"Components of the Wellness System" Technogym Website. 3 pages. URL: http://www.technogym.co.uk/business/__vti__g3__pIWsComp.asp?rpstry=11023__. Retrieved Jan. 3, 2007.

"Wellness Key." New Forest District Council. 1 page. URL: http://www.newforestdc.gov.uk/index.cfm?articleid=1657. Retrieved Jan. 3, 2007.

"Wellness System" Technogym Website. 2 pages. URL: http://www.technogymusa.com/__vti__g7__plsystem.aspx?rpstry=11902__. Retrieved Jan. 3, 2007.

Get in Gear, Apple, Inc., pp. 1-3, URL:http://apple.com/ipod/nike/gear.html [Retrieved Mar. 5, 2007].

Martinelli, Nicole. "Keyed Up: RFID in the Gym." Jul. 27, 2006. 3 pages. URL: http://www.wired.com/news/technology/0,71472-0.html?tw=wn__culture__2. Retrieved Jan. 2, 2007.

Nike and Apple Team Up to Launch Nike+iPod, Apple, Inc., p. 1, URL:http://www.apple.com/pr/library/2006/may/23nike.html [Retrieved Mar. 5, 2007].

Nike and iPod present shoe that gives feedback, Alexandria Sage and Martinne Geller Reuters, International Herald Tribune, pp. 1-2, URL:http://www.iht.com/bin/print__ipub.php?file=/articles/2006/05/24/business/nike.php.

Standard pins, Avibank Product Catalog, pp. 1-4, URL:http//www.avibank.com/products/product__display.cfm?product__id=1, [Retrieved Feb. 5, 2007].

USB flash drive, Wikipedia, pp. 1-9, URL:http//en.wikipedia.org/wiki/USB__flash__drive, [Retrieved Jan. 17, 2007].

Weight machine, Wikipedia, pp. 1-2, url:http//en.wikipedia.org/wiki/Weight__machine [retreived on Jan. 29, 2007].

"FlexiForce A201 Standard Force & Load Sensors," Tekscan, Inc., <http://www.tekscan.com/pdfs/DatasheetA201.pdf> [sent Apr. 24, 2008], p. 1.

"FlexiForce B201 Force & Load Sensors," Tekscan, Inc., <http://www.tekscan.com/pdfs/Datasheet-ELF-B201.pdf> [sent Apr. 24, 2008], p. 1.

"Wireless ELF—Freedom in Force Sensing," Tekscan, Inc., <http://www.tekscan.com/pdfs/WELF.pdf> [sent Apr. 24, 2008], p. 1.

"FlexiForce OEM and Custom Force Sensor Designs," Tekscan, Inc., <http://www.tekscan.com/flexiforce/OEM.html> [sent Apr. 24, 2008], p. 1-2.

"FlexiForce Focus—Spring 2008 Newsletter," Tekscan, Inc., <http://www.tekscan.com/flexiforce/flexifocus-spring08.html> [sent Apr. 16, 2008], p. 1-2.

"shotwatch.com—Golf Training Device to Improve Your Golf Game," Grip&Rip Technology Inc., LLC, <http://www.shotwatch.com/> [accessed May 26, 2008], p. 1.

"shotwatch.com—About Shotwatch," Grip&Rip Technology Inc., LLC, <http://shotwatch.com/index.php?option=com__content&task=view&id=30&Itemid=36> [accessed May 26, 2008], p. 1.

"ShotWatch is featured product on weekly Golf Smarter Podcast," WorldGolf.com, <http://www.worldgolf.com/newswire/browse/13123-ShotWatch-is-featured-product-on-weekly-Golf-Smarter-Podcast> [dated Mar. 17, 2008], pp. 1-4.

* cited by examiner

1500a

| 1510a DATE | 1512a MACHINES | 1514a SETTINGS | 1516a WEIGHT | 1518a REPS | 1520a ELAPSED t | 1522a CALORIES |
|---|---|---|---|---|---|---|
| 10/21 | PRESS #2 | 4TH POS. | 110 lbs. | 10 | 85 SEC | 35 |
| 10/21 | PRESS #2 | 4TH POS. | 140 lbs. | 5 | 60 SEC | 30 |
| 10/21 | LEG #1 | FULL VERT. | 40 lbs. | 25 | 120 SEC | 20 |
| 10/24 | | | | | | |
| 10/24 | | | | | | |
| | | | | | | |

1500b

| 1510b DATE | 1512b MACHINES | 1514b TOTAL CALS | 1516b TOTAL TIME | ETC. | | |
|---|---|---|---|---|---|---|
| 10/21 | PRESS #2<br>LEG #1 | 435 | 1hr 30min | | | |
| | | | | | | |
| | | | | | | |

DEVICES, SYSTEMS AND METHODS FOR RECEIVING, RECORDING AND DISPLAYING INFORMATION RELATING TO PHYSICAL EXERCISE

TECHNICAL FIELD

The following disclosure relates generally to devices, systems and methods for receiving, recording and displaying information relating to physical exercise and, more particularly, to devices and systems for use with weight machines.

BACKGROUND

In recent years, there has been a virtual explosion in the popularity of exercise and physical fitness because of the significant effect it can have on the quality of life. There are many popular forms of physical exercise including, for example, running, bicycling, and weight training. The growing interest in weight training is reflected by the growing number of gyms found in both public and private settings.

There are various types of weight training equipment. Typical weight machines, for example, use gravity as the primary source of resistance. A combination of simple machines (e.g., pulleys, levers, wheels, inclines, etc.) to change the mechanical advantage of the overall machine relative to the weight and convey the resistance to the person using the machine. Conventional stacked weight machines, such as those made by Cybex International, Inc. and Nautilus, Inc., typically include a stack of rectangular weight plates through which a vertical lifting bar passes. The lifting bar includes a plurality of holes configured to accept a pin. Each of the plates has a corresponding channel on its underside (or a hole through the middle) that aligns with one of the holes in the lifting bar when the lifting bar is in the lowered or at-rest position. To lift a selected number of the plates, the user inserts the pin through the channel and the corresponding hole in the lift bar at a selected weight level. As the user goes through the exercise motion, the lift bar rises and the pin supports all of the plates stacked above it. The various settings on the weight machine allow the user to select from several different levels of resistance over the same range of motion by simply inserting the pin into the lift bar at a desired weight level.

Conventional weight pins usually include a cylindrical shaft made of stainless steel or other hard metal. In its simplest form, a weight pin can be made from a single piece of cylindrical metal rod that is bent slightly at one end to form a handle for inserting and removing the pin into a weight stack. Other types of weight pins can include a plastic or metal handle portion that is attached to the cylindrical shaft which is inserted into the weight stack. The shaft can include spring-loaded ball bearings and/or other locking features to releasably engage the pin with the weight stack and prevent it from becoming dislodged during use of the weight machine. Some pins with locking features include a push button on the handle to facilitate engagement of the locking feature with the weight stack and/or lifting bar. One such pin is the Avibank AVK Push BIS6T840S lock pin.

One important aspect of any type of exercise program is the ability to track personal performance and progress. For example, people engaged in endurance or distance forms of exercise (e.g., running, swimming, bicycling, etc.) often track the distance and/or time associated with a particular run, swim, ride, etc. Similarly, people using cardiovascular exercise machines (e.g., treadmills, stair-steppers, stationary bicycles, etc.) are often interested in knowing how long they exercise or how many calories they burn during a particular session.

One shortcoming of conventional weight machines, however, is that they lack a convenient way for the user to track and record his or her progress on a particular machine or group of machines during a particular exercise session or over a given period of time. As a result, people engaged in weight training programs often rely on memory to keep track of how many weights they lifted on a particular occasion, or how many repetitions they performed on a particular machine. Rather then rely on memory, some people use notebooks to manually record information about their workout. Neither of these approaches, however, is particularly convenient. Accordingly, it would be advantageous to provide users of weight training equipment with the ability to record their progress and performance on a wide range of weight machines in a convenient manner.

Persons doing calisthenics and other types of "free weight" exercises also lack a convenient way to record the number of exercise repetitions they perform. For example, a person doing sit-ups has no easy way to automatically record the number of sit-ups he or she performs during a workout. The same is true for similar types of exercise such as chin-ups, jumping jacks, squats, push-ups, etc. Likewise, a person doing curls, bench press, or other types of weight training with one or more barbells also lacks a convenient way to record his or her effort. Accordingly, it would also be advantageous to provide persons doing these types of repetitive exercises with the ability to record their progress and performance in a convenient manner.

DETAILED DESCRIPTION

Figure 1:
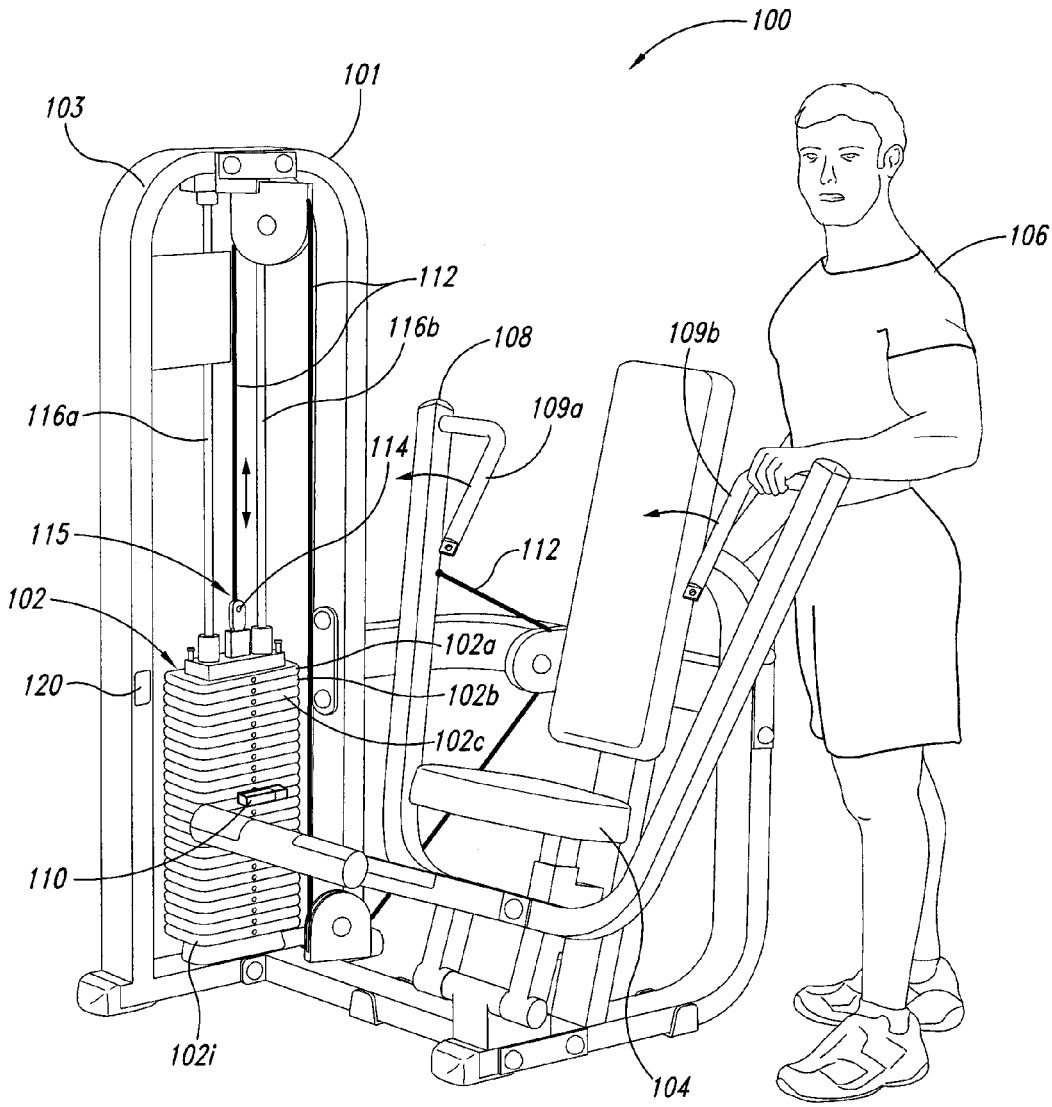
FIG. 1 is an isometric view of a suitable environment for use of an instrumented weight pin configured in accordance with an embodiment of the invention.

The following disclosure describes various embodiments of devices, systems and methods for receiving, recording, and/or displaying information relating to the use of weight machines and other forms of physical exercise. In one embodiment, for example, the invention includes an instrumented weight pin that can be used for selecting a desired number of weights on a conventional stacked weight exercise machine. In this embodiment, the pin can include one or more sensors for detecting various parameters associated with a particular exercise set. For example, the pin can include a force sensor for detecting a load on the pin during the exercise set. The pin can also include an accelerometer for detecting accelerations of the weight stack in one or more directions.

As described in greater detail below, the instrumented weight pin can further include a microprocessor and associated memory. The microprocessor can execute computer-readable instructions to determine the amount of weight being lifted, the number of repetitions, and/or other useful information associated with a particular exercise set. This information can then be stored in pin memory. After a particular workout session or series of sessions, the user can download the exercise data from the pin to a user computer, PDA, cell phone, or other display device to view the information, chart progress, estimate calories burned, etc. In this embodiment, the instrumented weight pin functions as a data acquisition device that can be used with a wide variety of conventional stacked weight exercise machines without modification to the weight pin or the machines.

In a further embodiment, the instrumented weight pin can include a detachable data acquisition module that carries the microprocessor and memory discussed above. As described in greater detail below, the data acquisition module can store information about an exercise session or a series of sessions on a wide variety of weight machines. In one embodiment, the data acquisition module can be removed from the instrumented weight pin and connected to a personal computer or other signal-processing device (via, e.g., a USB port or other wired connection, a wireless connection, etc.). As described in greater detail below, various embodiments of the invention can include computer-readable instructions that cause the personal computer or other display device to display the exercise information in various user-friendly formats. The formats can include, for example, various types of charts and graphs that illustrate the user's progress over time and provide other types of information relating to, e.g., workout duration, caloric burn rates, cardiovascular parameters, etc.

Another embodiment of the invention includes a machine information unit that can be associated with a particular exercise machine and used in conjunction with the instrumented weight pin. As described in greater detail below, the machine information unit can include an RFID tag or other wireless communication device, or a wired communication device, for transmitting information about the weight machine to the weight pin and/or receiving information from the weight pin. The information transmitted from the machine information unit can include, for example, machine type (e.g., bench press, leg press, etc.), machine number, machine manufacturer, etc., as well as machine settings and other information necessary for the weight pin to convert sensor data into weight information. When the user approaches the machine, he or she can conveniently "swipe" the weight pin past the RFID tag or take other steps to download the information to the weight pin. In addition, the user can also upload information from the weight pin to the machine information unit. Such information can include, for example, various types of user-specific information such as past workout performance on the particular weight machine, name, age, sex, body weight, etc. In some embodiments, the machine information unit can use this information to display relevant information for the user, such as a graph of performance over time on the weight machine, suggested workout parameters, etc. In addition, the machine information unit can also process the uploaded information in various ways before transmitting it back to the weight pin for storage and/or later display.

Although not required, aspects and embodiments of the invention will be described in the general context of computer-executable instructions, such as routines executed by a general-purpose computer, e.g., a personal computer, PDA, etc. Those skilled in the relevant art will appreciate that the invention can be practiced with other computer system configurations, including Internet appliances, hand-held devices, wearable computers, cellular or mobile phones, multi-processor systems, microprocessor-based or programmable consumer electronics, set-top boxes, network PCs, mini-computers, mainframe computers and the like. Aspects of the invention can be embodied in a special purpose computer or data processor that is specifically programmed, configured or constructed to perform one or more of the computer-executable instructions explained in detail below. Indeed, the terms "computer," "processor," "microprocessor" and the like as used generally herein refer to any of the above devices, as well as any data processor.

The invention can also be practiced in distributed computing environments, where tasks or modules are performed by remote processing devices, which are linked through a communications network, such as a Local Area Network ("LAN"), Wide Area Network ("WAN") or the Internet. In a distributed computing environment, program modules or sub-routines may be located in both local and remote memory storage devices. Aspects of the invention described below may be stored or distributed on computer-readable media, including magnetic and optically readable and removable computer discs, stored as firmware in chips (e.g., EEPROM chips), as well as distributed electronically over the Internet or over other networks (including wireless networks). Those skilled in the relevant art will recognize that portions of the invention may reside on a server computer, while corresponding portions reside on a client computer. Data structures and transmission of data particular to aspects of the invention are also encompassed within the scope of the invention.

Aspects of the invention may be practiced in a variety of other computing environments. For example, a distributed computing environment with a web interface includes one or more user computers, each of which includes a browser program module that permits the computer to access and exchange data with the Internet, including web sites within the World Wide Web portion of the Internet. The user computers may include one or more central processing units or other logic-processing circuitry, memory, input devices (e.g., keyboards and pointing devices), output devices (e.g., display devices and printers), and storage devices (e.g., magnetic, fixed and floppy disk drives, and optical disk drives). User computers may include other program modules such as an operating system, one or more application programs (e.g., word processing or spread sheet applications), and the like. User computers include wireless computers, such as mobile phones, personal digital assistants (PDA's), palm-top computers, etc., which communicate with the Internet via a wireless link. The computers may be general-purpose devices that can be programmed to run various types of applications, or they may be single-purpose devices optimized or limited to a particular function or class of functions.

Such computing environments can also include at least one server computer coupled to the Internet or World Wide Web which performs much or all of the functions for receiving, routing and storing of electronic messages, such as web pages, audio signals and electronic images. While the Internet is discussed here, a private network, such as an intranet may likewise be used herein. The network may have a client-server architecture, in which a computer is dedicated to serving other client computers, or it may have other architectures such as a peer-to-peer, in which one or more computers serve simultaneously as servers and clients. A database or databases, coupled to the server computer(s), stores much of the web pages and content exchanged between the user computers. The server computer(s), including the database(s), may employ security measures to inhibit malicious attacks on the system and to preserve integrity of the messages and data stored therein (e.g., firewall systems, secure socket layers (SSL) password protection schemes, encryption, and the like).

The server computer may include a server engine, a web page management component, a content management component and a database management component. The server engine performs basic processing and operating system level tasks. The web page management component handles creation and display or routing of web pages. Users may access the server computer by means of a URL associated therewith. The content management component handles most of the functions in the embodiments described herein. The database management component includes storage and retrieval tasks with respect to the database, queries to the database, and storage of data such as animation graphics and audio signals.

One skilled in the relevant art will appreciate that the concepts of the invention can be used in various environments other than location based or the Internet. In general, a display description may be in HTML, XML or WAP format, email format or any other format suitable for displaying information (including character/code-based formats, algorithm-based formats (e.g., vector generated), and bitmapped formats). Also, various communication channels, such as local area networks, wide area networks, or point-to-point dial-up connections, may be used instead of the Internet. The system may be conducted within a single computer environment, rather than a client/server environment. Also, the user computers may comprise any combination of hardware or software that interacts with the server computer, such as television-based systems and various other consumer products through which commercial or noncommercial transactions can be conducted. The various aspects of the invention described herein can be implemented in or for any e-mail environment.

Certain details are set forth in the following description and in FIGS. 1-17 to provide a thorough understanding of various embodiments of the invention. Other details describing well-known structures and systems often associated with weight training machines, signal processing systems, and electronic display devices, however, are not set forth in the following disclosure to avoid unnecessarily obscuring the description of various embodiments of the invention.

Many of the details, dimensions, and other features shown in the Figures are merely illustrative of particular embodiments of the invention. Accordingly, other embodiments can have other details, dimensions, and features without departing from the spirit or scope of the present invention. In addition, further embodiments of the invention can be practiced without several of the details described below.

In the Figures, identical reference numbers identify identical, or at least generally similar, elements. To facilitate the discussion of any particular element, the most significant digit or digits of any reference number refer to the Figure in which that element is first introduced. For example, element 110 is first introduced and discussed with reference to FIG. 1.

FIG. 1 is an isometric view of an exercise system 100 configured in accordance with an embodiment of the invention. The exercise system 100 includes a device 110 for receiving and/or recording information related to use of an exercise machine 101. In the illustrated embodiment, the device 110 is an instrumented weight pin (referred to hereinafter as the instrumented weight pin 110 for ease of reference), and the exercise machine 101 is a conventional stacked weight exercise machine having a plurality of weights 102 (identified individually as weights 102*a*-102*i*). A weight support member 114 is movably suspended from a cable 112 and hangs downward through the weight stack 102. Although not illustrated in FIG. 1, the support member 114 includes a plurality of through-holes positioned adjacent to corresponding weights 102 when the support member 114 is in the relaxed or lowered position shown in FIG. 1. The cable 112 attaches the support member 114 to a movable exercise bar 108 via a system of pulleys.

To use the exercise machine 101 with the instrumented weight pin 110 ("weight pin 110") of the present invention, the user switches the weight pin power "on" and inserts the weight pin 110 through a hole or slot in the desired weight 102. The user 106 pushes the weight pin 110 through the slot until it passes through the adjacent hole in the support member 114. The user 106 then sits on a seat 104 and grasps a right handle 109*a* and a left handle 109*b* on the exercise bar 108. As the user 106 presses the bar 108 forward it rotates, pulling on the cable 112 and drawing the support member 114 upwardly. As the support member 114 moves upwardly, the weight pin 110 moves all of the weights 102 stacked above the weight pin 110 upwardly along parallel guide members 116*a* and 116*b*. When the user 106 relaxes his arms and allows his hands to move back toward his chest, the lifted weights 102 return downwardly to the stack.

As described in greater detail below, the weight pin 110 includes instrumentation that enables the pin to acquire information about the exercise set (e.g., amount of weight lifted, repetitions, etc.) and store this information for later download and review by the user 106. After the user 106 is done working out on the machine 101, he can extract the weight pin 110 from the weight stack 102 and insert it into a weight stack on a different exercise machine prior to beginning his workout on that machine. In this manner, the user 106 is able to record information relating to his entire workout session with the weight pin 110, regardless of the particular weight machines he elects to use.

In a further aspect of this embodiment, the exercise system 100 can include a machine information unit 120 that is attached to, or otherwise associated with, the exercise machine 101. As described in greater detail below, the machine information unit 120 ("information unit 120") can contain information about the exercise machine 101 which can be passively or actively transmitted to the weight pin 110. This information can include machine identification information and/or other information related to the exercise machine 101 or a particular exercise set. This information can be stored on the weight pin 110 and associated with the data collected by the weight pin 110 during use of the machine 101. Having this information can enable the weight pin 110 to provide a complete picture of a workout session or sessions by including details such as machines used, weight settings, repetitions, time of day, day of week, etc. In other embodiments, the invention can include a machine information unit configured to receive information (e.g., user-specific information) from the weight pin 110. The information can be processed by the machine information unit and displayed for viewing by the user, and/or transmitted back to the weight pin 110 for storage and/or later download to a display device.

Figure 2:
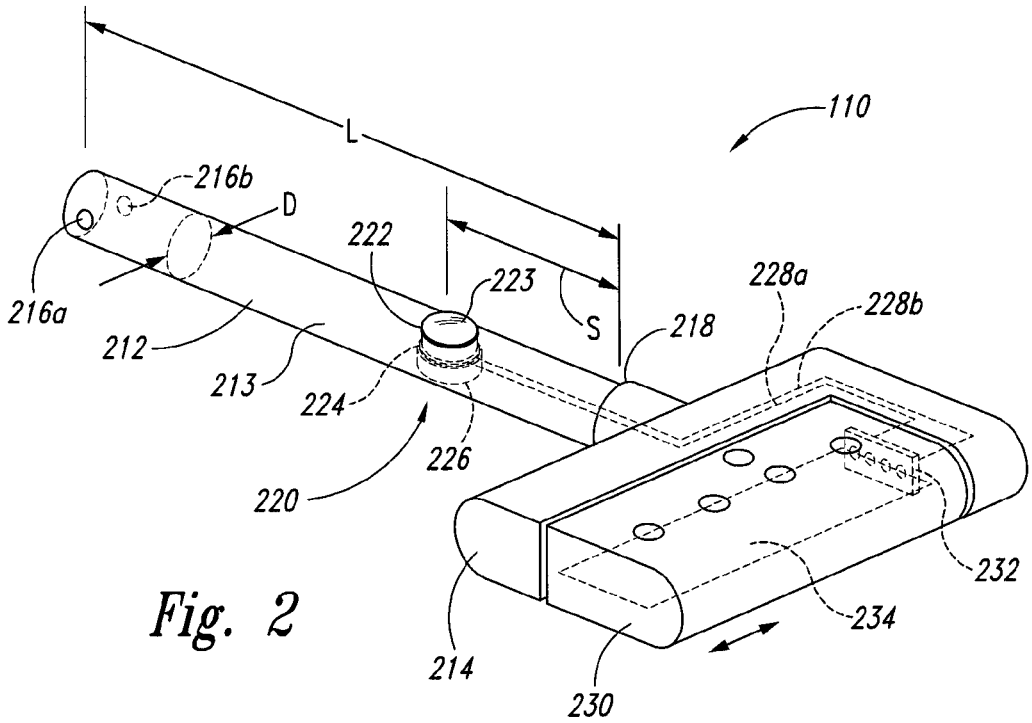
FIG. 2 is an enlarged isometric view of an instrumented weight pin configured in accordance with an embodiment of the invention.

FIG. 2 is an enlarged isometric view of the weight pin 110 configured in accordance with an embodiment of the invention. In one aspect of this embodiment, the weight pin 110 includes a shaft portion 212 extending outwardly from a handle portion 214. As discussed above with reference to FIG. 1, the shaft portion 212 can serve as a weight support portion configured to extend through a weight stack on a conventional stacked weight exercise machine and engage a support member. For example, in one embodiment, the shaft portion 212 can include an outer surface 213 having a diameter D of from about 0.7 cm to about 1.3 cm, such as about 1 cm. The shaft portion 212 can also have a length L of from about 8 cm to about 15 cm, such as about 11 cm. In other embodiments, however, the shaft portion 212 can have other dimensions to accommodate other types of weights and weight machines, and/or for other reasons. For example, in other embodiments weight pins configured in accordance with the present invention can have rectangular, square, and/or other cross-sectional shapes. In addition to the foregoing, the shaft portion 212 can also include one or more retaining features (such as, for example, a first spring-loaded ball-bearing 216*a* and a second spring-loaded ball-bearing 216*b*) for releasably retaining the shaft portion 212 in a weight stack during an exercise set. The shaft portion 212 can be manufactured from a hard metal, such as stainless steel, and/or other suitable materials known in the art.

In another aspect of this embodiment, the shaft portion 212 carries a sensor assembly 220. The sensor assembly 220 includes a movable puck or actuator 222 with a bearing surface 223 that protrudes slightly above the outer surface 213 of the shaft portion 212. The actuator 222 is offset a distance S from a shoulder 218 on the handle portion 214. As described in greater detail below with reference to FIGS. 5A-5C, the offset distance S can be selected so that the bearing surface 223 contacts the lifted weight stack (or the support member) in a desired location during an exercise set. When the weight stack (or the support member) presses against the bearing surface 223, the actuator 222 presses against a load sensor 224. The load sensor 224 is supported by a sensor support 226 which can be press-fit into the shaft portion 212 or otherwise fixed relative to the shaft portion 212 by adhesive, mechanical fastening, welding, etc. In the illustrated embodiment, the load sensor 224 can include a compression force sensor, such as a Flexiforce sensor from Tekscan, Inc., serial no. A-201-100. In other embodiments, the sensor assembly 220 can include other types of force sensors including, for example, various types of axial load cells, strain gauges, and/or other types of sensors known in the art for measuring force.

In a further aspect of this embodiment, the weight pin 110 includes a data acquisition module 230. In the illustrated embodiment, the data acquisition module 230 is detachably coupled to the handle portion 214 via an electronic interface 232. In other embodiments, however, the data acquisition module 230 may not be removable from the weight pin 110. In these embodiments, for example, the data acquisition module 230 and/or the components thereof can be incorporated into, e.g., the handle portion 214 of the weight pin 110, and/or otherwise fixedly attached to the weight pin 110. The data acquisition module 230 carries electronic circuitry 234 that is operably connected to the load sensor 224 by data links 228 (illustrated as a first link 228*a* and a second link 228*b*). As described in greater detail below with reference to, e.g., FIG. 7, the electronic circuitry 234 can include, among other things, a microprocessor, a power source, memory, etc. For example, in various embodiments, the data acquisition module 230 can include a transportable data storage device with flash memory, such as a flash memory card or stick.

Figure 3A:
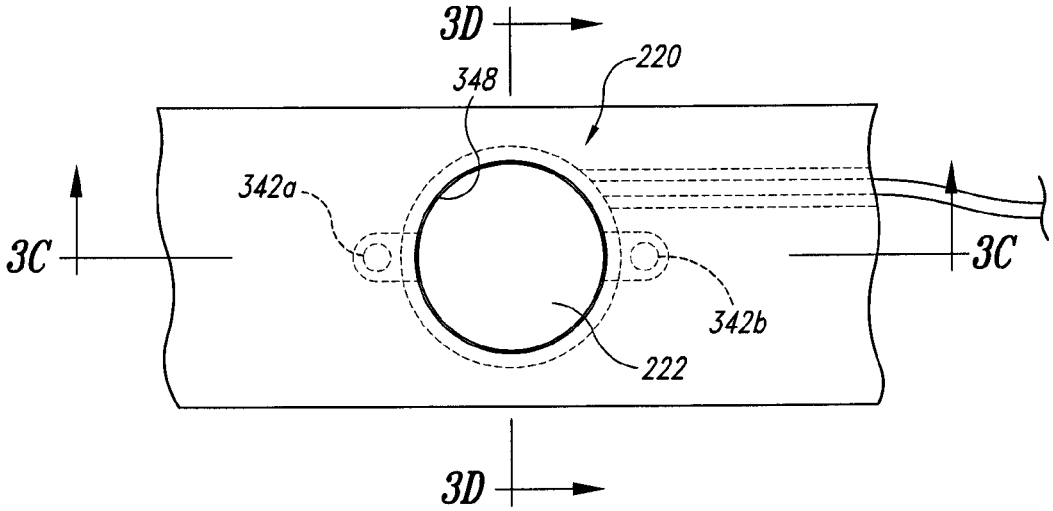
FIGS. 3A-3D are a series of enlarged views of a portion of the weight pin of FIG. 2, illustrating various aspects of a load sensor assembly configured in accordance with an embodiment of the invention.
Figure 3B:
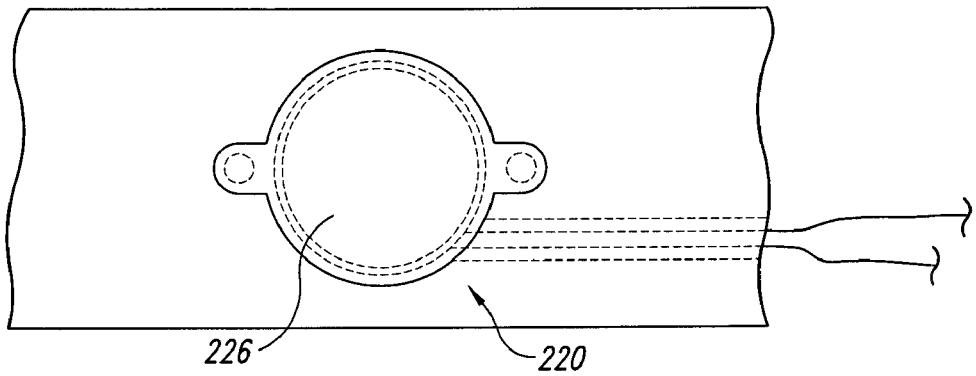
Figure 3C:
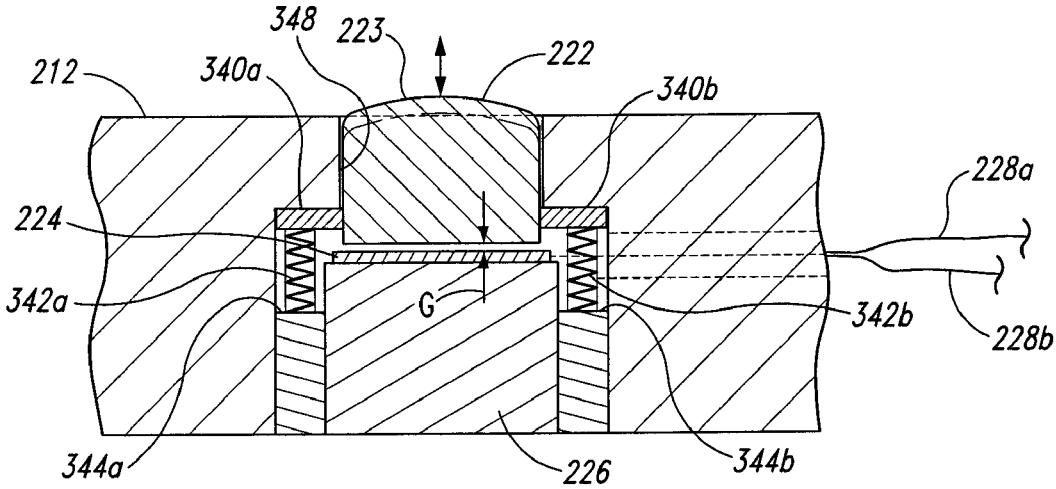
Figure 3D:
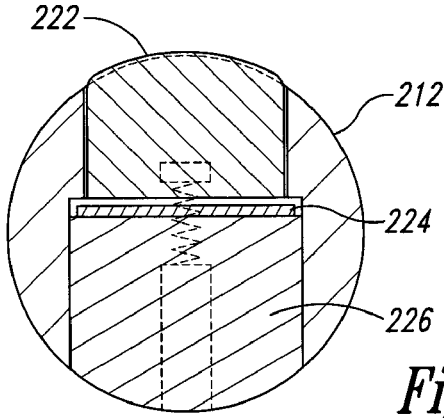

FIG. 3A is a top view of the sensor assembly 220 of FIG. 2, and FIG. 3B is a corresponding bottom view. The words "top" and "bottom" are used here for ease of reference only and do not connote orientation. FIG. 3C is a side cross-sectional view taken along line 3C-3C in FIG. 3A, and FIG. 3D is an end cross-sectional view taken along line 3D-3D in FIG. 3A. Referring first to FIG. 3C, the actuator 222 is slidably positioned in a bore 348 that extends transversely through the pin shaft 212. In the illustrated embodiment, the actuator 222 includes a first tab 340*a* extending outwardly from one side, and a second tab 340*b* extending outwardly from an opposing side. A first spring 342*a* is compressed between the first tab 340*a* and a first surface 344*a* of the sensor support 226. Similarly, a second spring 342*b* is compressed between the second tab 340*b* and a second surface 344*b* of the sensor support 226. The actuator 222 can be spaced apart from the load sensor 224 by a small gap G of, e.g., about 0.0 inch to about 0.01 inch, when the actuator 222 is not depressed.

When the weights (not shown) press the actuator 222 against the sensor 224, the sensor 224 communicates information relating to the corresponding force to the electronic circuitry 234 (FIG. 2) via the first and second links 228. When the load on the actuator 222 is removed, the springs 342 push the actuator 222 away from the sensor 224 to relieve the load on the sensor 224.

Figure 4A:
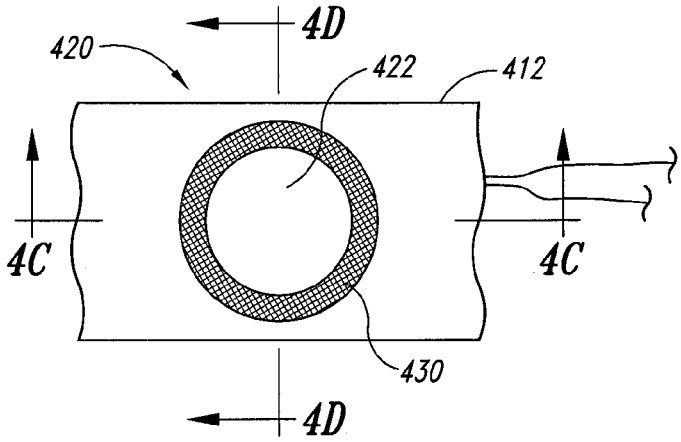
FIGS. 4A-4D are a series of enlarged views illustrating various aspects of a weight pin load sensor assembly configured in accordance with another embodiment of the invention.
Figure 4B:
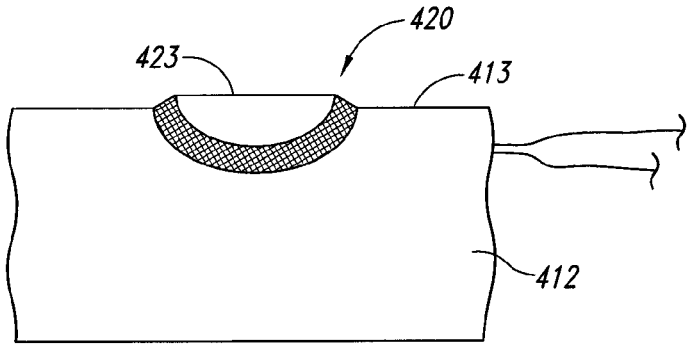
Figure 4C:
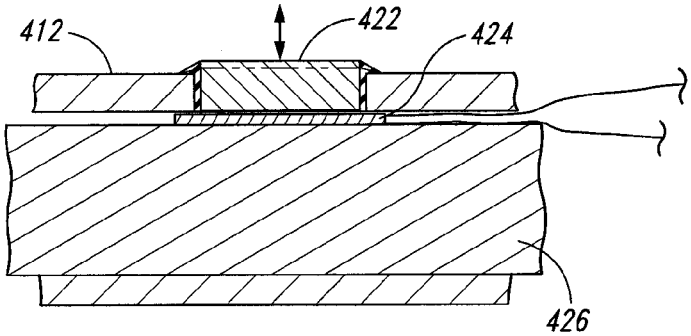
Figure 4D:
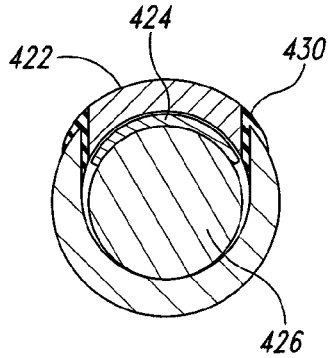

FIG. 4A is a top view of a sensor assembly 420 configured in accordance with another embodiment of the invention, and FIG. 4B is a corresponding side view. FIG. 4C is a side cross-sectional view taken along line 4C-4C in FIG. 4A, and FIG. 4D is an end cross-sectional view taken along line 4D-4D in FIG. 4A. Referring first to FIGS. 4A and 4B together, the sensor assembly 420 of this embodiment includes an actuator 422 having a bearing surface 423 that is slightly offset from an outer surface 413 of a shaft portion 412. The actuator 422 is movably retained in the shaft portion 412 by a flexible adhesive 430, such as a silicone adhesive, a polyurethane adhesive, or other suitably resilient material known in the art.

As shown in FIGS. 4C and 4D, a cylindrical rod 426 extends through the shaft portion 412 and supports a load sensor 424 adjacent to the actuator 422. When the shaft portion 412 is installed in a weight stack (not shown), the weights (or the support member) press against the bearing surface 423, causing the actuator 422 to move toward the rod 426 and compress the load sensor 424. When the load on the actuator 422 is removed, the resilient adhesive 430 causes the actuator 422 to return to its original position, thereby relieving the corresponding load on the load sensor 424.

As FIGS. 3A-4D illustrate, there are a number of different ways in which a load sensor can be operably carried by the shaft portion 212 of the weight pin 110 (FIG. 2). Accordingly, the approaches described herein are by way of example only and are not meant to be exhaustive. In other embodiments, other approaches can be used to position a load sensor in a shaft portion of a weight pin without departing from the spirit or scope of the present invention.

Figure 5A:
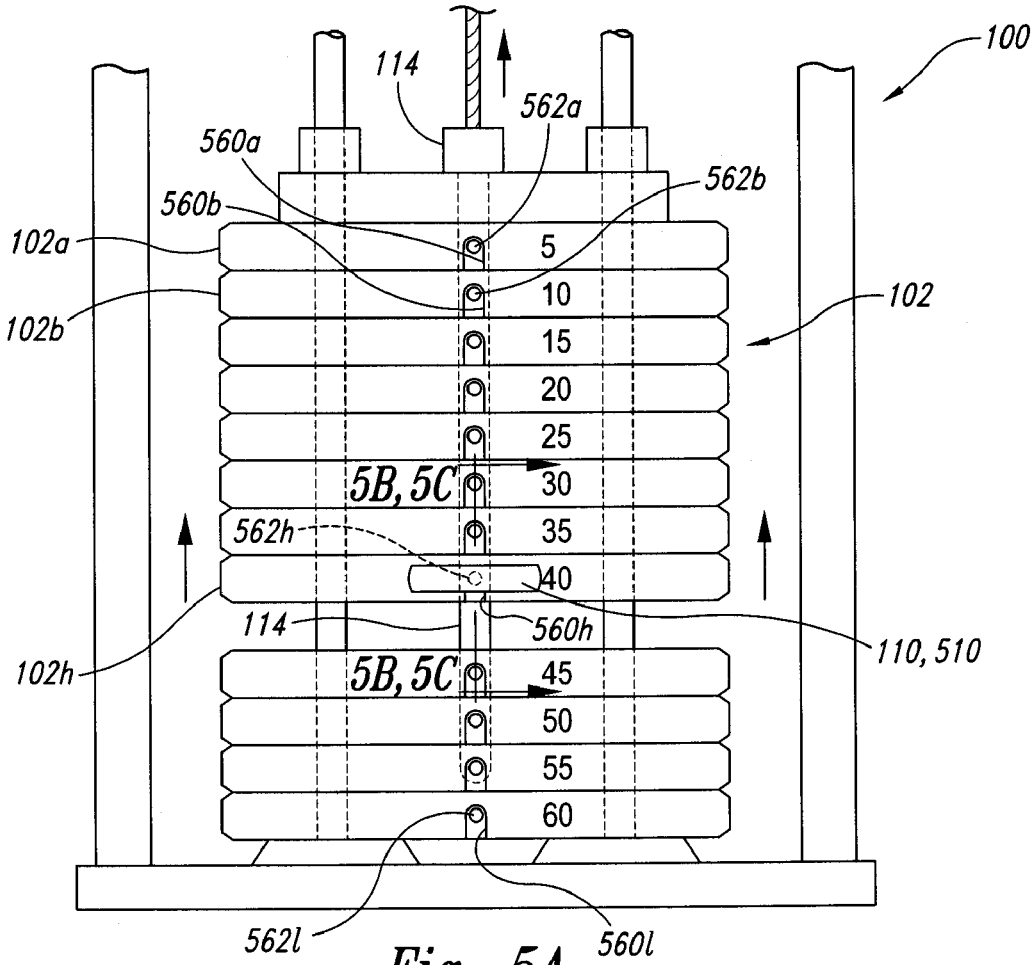
FIG. 5A is a front view of an instrumented weight pin installed in a weight stack in accordance with an embodiment of the invention.

FIG. 5A is a front view of the weight pin 110 (or a weight pin 510) installed in the weight stack 102 at a desired weight level. Referring first to FIG. 5A, each of the individual weights 102 includes a corresponding hole, cut-away or channel 560 (identified individually as channels 560*a-l*) positioned adjacent to a corresponding through-hole 562 (identified individually as through-holes 562*a-l*) in the support member 114. In the illustrated embodiment, for example, the weight pin 110 extends through the channel 560*h* in the weight 102*h*, and through the adjacent hole 562*h* in the support member 114. In this way, the weight pin 110 couples the weights 102*a-h* to the support member 114 during the exercise set.

Figure 5B:
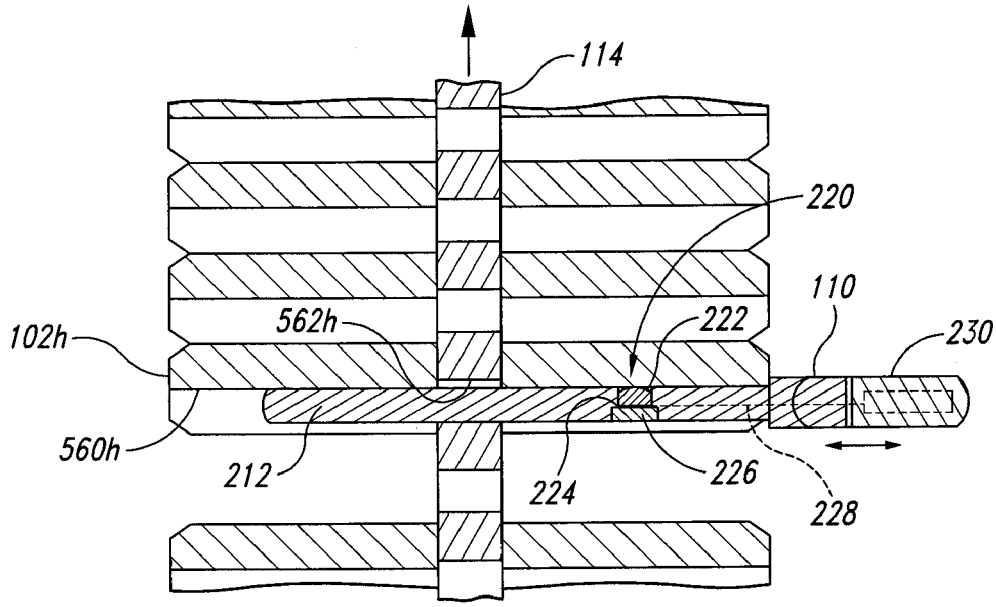
FIGS. 5B and 5C are enlarged cross-sectional views taken substantially along lines 5B-5B and 5C-5C, respectively, in FIG. 5A.

FIG. 5B is a cross-sectional view taken along line 5B-5B in FIG. 5A illustrating one possible position of the sensor assembly 220 relative to the weight stack 102 and the support member 114. In this embodiment, the sensor assembly 220 is positioned such that the weight 102*h* bears against the actuator 222. The sensor 224 detects a compression force associated with the weights 102*a-h*, and transmits corresponding information to the electronic circuitry 234 in the data acquisition module 230. As described in greater detail below, the electronic circuitry 234 can include a suitable microprocessor to convert the compression force detected by the sensor 224 into a corresponding weight for the particular exercise set.

Figure 5C:
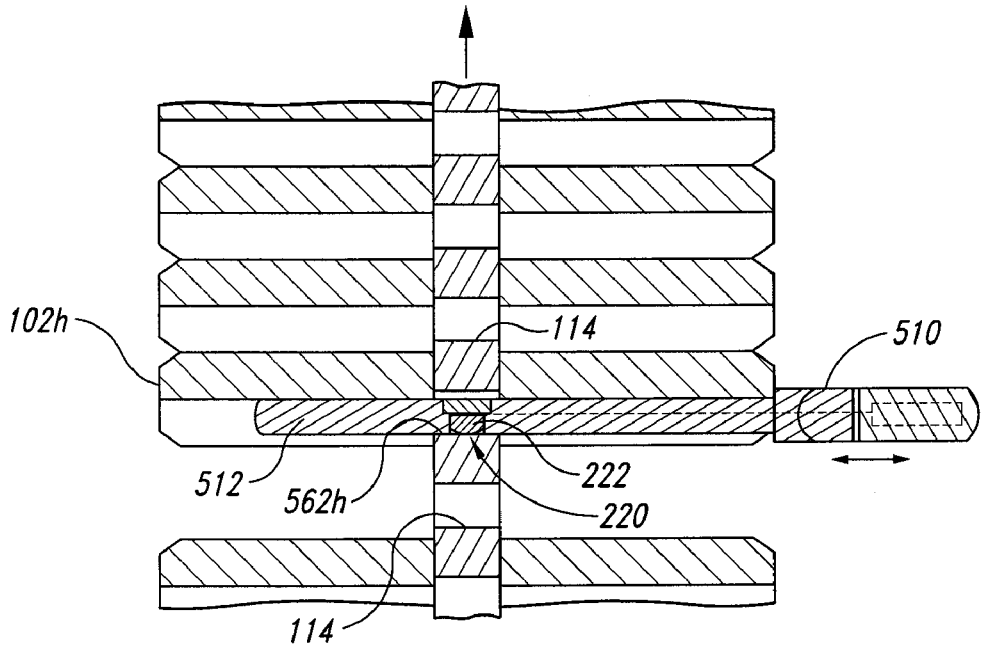

FIG. 5C is a cross-sectional view taken substantially along line 5C-5C in FIG. 5A, illustrating another embodiment of the weight pin 510 in which the sensor assembly 220 is positioned adjacent to the through-hole 562*h* in the support member 114. In this embodiment, the actuator 222 is directed downwardly so that the force associated with the weights 102*a-h* presses the actuator 222 against a lower surface of the through-hole 562*h*.

Figure 6A:
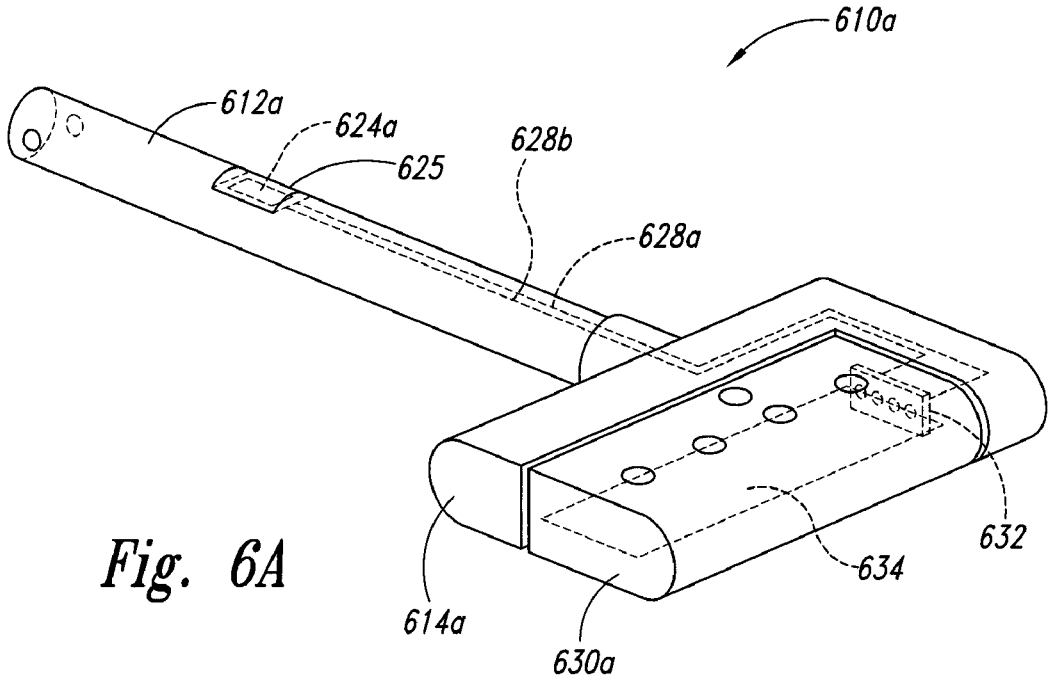
FIG. 6A is an isometric view of an instrumented weight pin configured in accordance with another embodiment of the invention.

FIG. 6A is an enlarged isometric view of an instrumented weight pin 610*a* configured in accordance with another embodiment of the invention. In one aspect of this embodiment, the weight pin 610*a* includes a shaft portion 612*a* fixedly attached to a handle portion 614*a*. A data acquisition module 630*a* is detachably coupled to the handle portion 614*a* via an electronic interface 632. The shaft portion 612*a*, the handle portion 614*a* and the data acquisition module 630*a* can be at least generally similar in structure and function to the corresponding features of the weight pins 110 and 510 described above with reference to FIGS. 1-5C. In one aspect of this particular embodiment, however, the weight pin 610*a* can include a strain gauge 624*a* (e.g., a foil strain gauge) bonded or otherwise attached to the shaft portion 612*a* to detect strain of the shaft portion 612*a* during an exercise set.

The strain gauge 624*a* can be operably connected to electronic circuitry 634 via links 628. In operation, the shaft portion 612*a* is inserted in a weight stack, and the bending strain of the shaft portion 612*a* under load is detected by the strain gauge 624*a*. The electronic circuitry 634 can be configured to convert the detected strain into a corresponding weight load before storing the data in associated memory. Alternatively, the raw strain data can be stored in memory and converted to a weight load after it is downloaded to another processing device for display. The weight pin 610*a* can additionally include a protective compound 625 (e.g., epoxy) applied over the strain gauge 624*a* to avoid damage to the strain gauge 624*a* during use of the weight pin 610*a*.

Figure 6B:
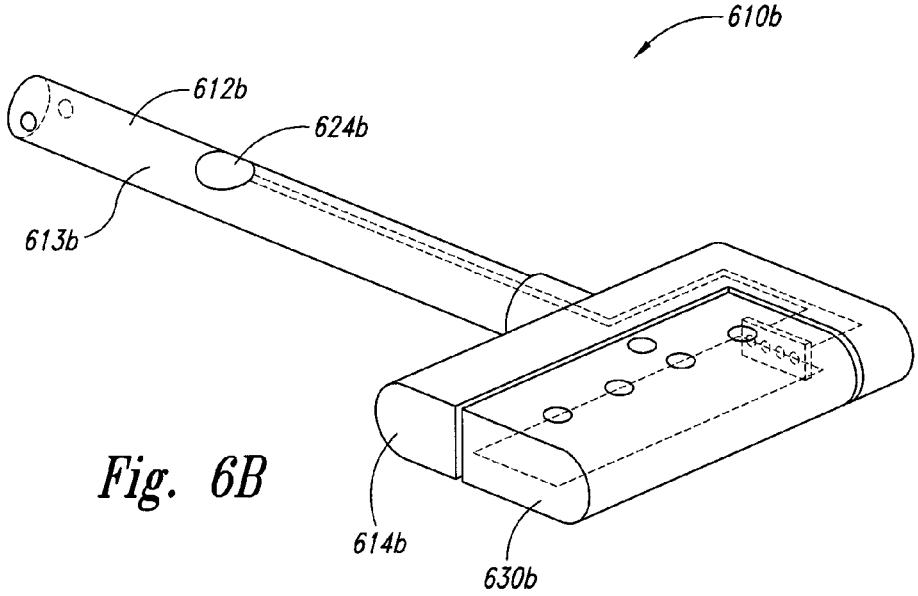
FIG. 6B is an isometric view of an instrumented weight pin configured in accordance with a further embodiment of the invention.

FIG. 6B is an enlarged isometric view of an instrumented weight pin 610*b* configured in accordance with another embodiment of the invention. In one aspect of this embodiment, the weight pin 610*b* includes a shaft portion 612*b* extending outwardly from a handle portion 614*b*. Many features of the weight pin 610*b* can be at least generally similar in structure and function to the corresponding features of the weight pins 110 and 610*a* described above. In one aspect of this particular embodiment, however, the weight pin 610*b* includes a load sensor 624*b* (e.g., a Flexiforce sensor from Tekscan, Inc.) which is fixedly attached to an outer surface 613 of the shaft portion 612*b*. The load sensor 624*b* can be bonded to the exterior surface 613*b* with a suitable adhesive, such as an epoxy adhesive, a silicone adhesive, and/or other suitable adhesives known in the art. In addition, a protective coating (not shown) of silicone, epoxy, polyurethane, and/or other suitable compound can be applied over the load sensor 624*b* to protect the load sensor 624*b* from damage during use. In operation, the shaft portion 612*b* is inserted into a weight stack so that the load sensor 624*b* is positioned in contact with a lower surface of a weight support member through-hole, as shown in, e.g., FIG. 5C. In another embodiment, the load sensor 624*b* can be positioned in contact with the lower-most weight in the lifted stack, as shown in, e.g., FIG. 5B.

Figure 6C:
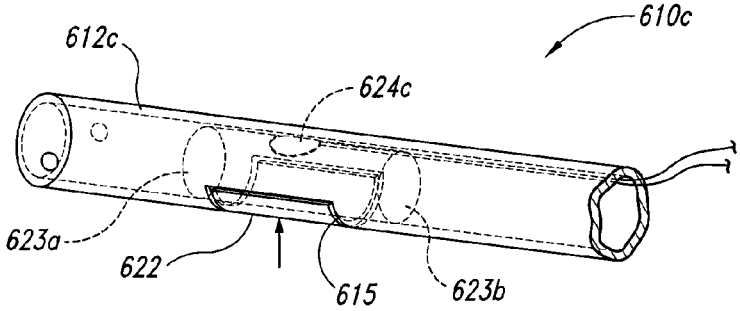
FIG. 6C is an enlarged isometric view of a shaft portion of a weight pin configured in accordance with yet another embodiment of the invention.

FIG. 6C is an enlarged isometric view of a shaft portion 612*c* of a weight pin 610*c* configured in accordance with yet another embodiment of the invention. In this embodiment, a load sensor 624*c* is bonded or otherwise attached to an actuator 622 that is carried by the shaft portion 612*c*. The actuator 622 is movably positioned in the shaft portion 612*c* so that it will be aligned with a lower surface of a support member through-hole (e.g., the through-hole 562*h* shown in FIG. 5C) when the weight pin 610*c* is inserted into a weight stack.

Figure 6D:
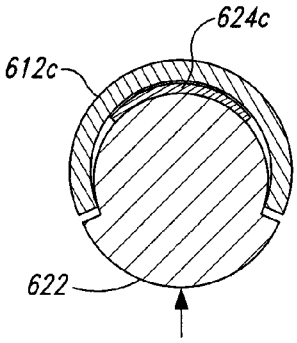
FIG. 6D is a cross-sectional end view of the shaft portion of FIG. 6C.
Figure 6E:
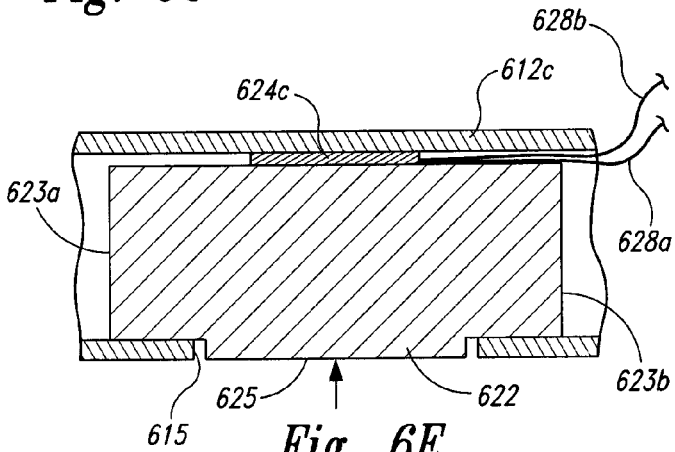
FIG. 6E is a corresponding cross-sectional side view of the shaft portion of FIG. 6C.

FIG. 6D is a cross-sectional end view of the shaft portion 612*c* taken through the actuator 622, and FIG. 6E is a corresponding cross-sectional side view of the shaft portion 612*c* taken through the actuator 622. Referring to FIGS. 6C-6E together, the actuator 622 includes a first end portion 623*a* spaced apart from an opposing second end portion 623*b*. In the illustrated embodiment, the actuator 622 further includes a raised portion 625 which protrudes through an opening 615 in the shaft portion 612*c*. The raised portion 625 should be at least as long as the width of the support member on the weight machine (not shown), so that the lower surface of the support member will only contact the raised portion 625 during the exercise. The load sensor 624*c* is attached to the actuator 622 opposite the raised portion 625.

In operation, the weight pin 610*c* is inserted into a weight stack so that the raised portion 625 of the actuator 622 contacts a lower surface of a weight support member throughhole (not shown). When the user raises the weight support member during an exercise set, the support member compresses the load sensor 624*c* between the actuator 622 and the opposing inner surface of the shaft portion 612*c*. Data corresponding to the compression load detected by the load sensor 624*c* is then transmitted to the weight pin data acquisition module (not shown) via data links 628.

Figure 7:
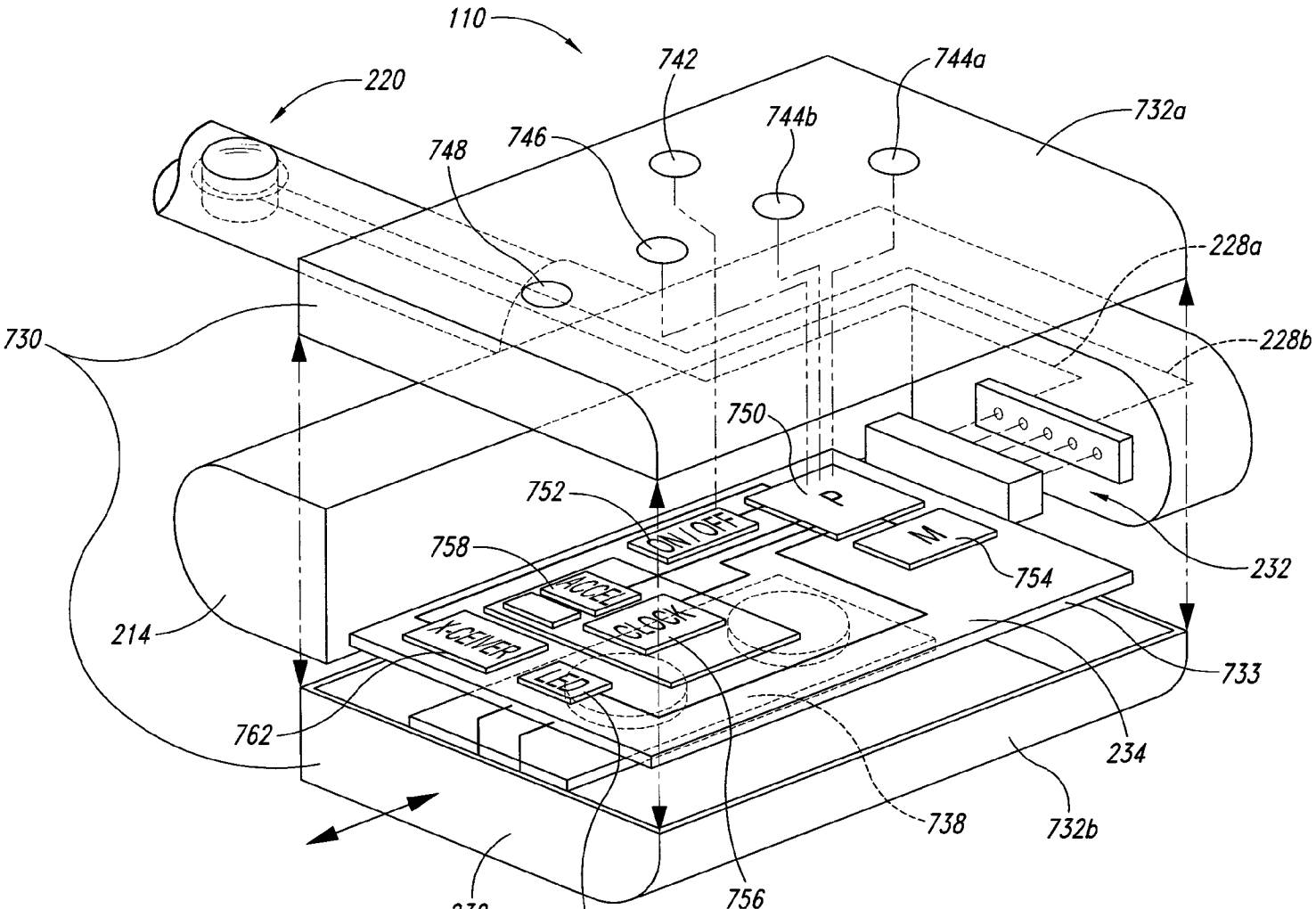
FIG. 7 is an exploded isometric view of a weight pin data acquisition module configured in accordance with an embodiment of the invention.

FIG. 7 is an enlarged, partially exploded isometric view of the data acquisition module 230 of FIG. 2, configured in accordance with an embodiment of the invention. In the illustrated embodiment, the electronic circuitry 234 is positioned within a clamshell housing 730 having a first half 732*a* and a corresponding second half 732*b*. The housing 730 can be manufactured from injection-molded plastic or other suitable materials known in the art. The electronic circuitry 234 receives power from a power source 738 (e.g., a battery, such as one or more lithium, button-type batteries, a 9V dry cell battery, etc.) which is also positioned within the housing 730.

The electronic circuitry 234 includes a plurality of electronic components (shown schematically in FIG. 7) carried on an electronic device substrate 733 (e.g., a printed circuit board, printed wire board, and/or other suitable substrate known in the art). In the illustrated embodiment, the electronic circuitry 234 includes a power on/off switch 752 operably connected to a microprocessor 750. The microprocessor 750 can be configured to execute computer-readable instructions stored on associated memory 754 (e.g., non-volatile memory). The microprocessor 750 can also include its own memory with computer-readable operating instructions. The electronic circuitry 234 can also include an accelerometer 758 and a clock 756 (e.g., a quartz clock). As described in greater detail below, the accelerometer 758 can detect motion of the weight pin 110 during an exercise set and provide this information to the microprocessor 750 along with time data from the clock 756. The microprocessor 750 can determine various performance parameters associated with a particular exercise set (e.g., selected weight, number of repetitions, etc.) based on the information received from the accelerometer 758, the sensor assembly 220, and the clock 756. These parameters can be stored in the memory 754 for later download to a personal computer or other display device.

The electronic circuitry 234 can additionally include a transceiver 762 for receiving radio-frequency (RF) or other wireless signals from the machine information unit 120 shown in FIG. 1. In one embodiment, for example, the transceiver 762 can include an RF transceiver with an associated scanning antenna (not shown) that broadcasts short-range RF signals. In this embodiment, the information unit 120 on the exercise machine 101 can include a transponder tag (e.g., a RFID tag with an associated microchip or other processing device) that is activated by the signals from the scanning antenna on the transceiver 762. In response to the signals, the transponder can transmit the machine information on its microchip (e.g., machine type, machine settings, etc.) back to the scanning antenna on the transceiver 762. The machine information can be stored in the memory 754 and associated with the performance data (e.g., selected weight, number of repetitions, elapsed time, etc.) for the exercise set. In other embodiments, the transceiver 762 can include other types of data receivers for receiving information about exercise machines and/or other information. Such receivers can include both wired and wireless (e.g., RF, cellular, satellite, microwave, infrared, etc.) receivers. In yet other embodiments, the transceiver 762 can be omitted.

The electronic circuitry 234 can further include an indicator 760 to alert the user when the data acquisition module 230 is operational and/or performing certain functions. In the illustrated embodiment, the indicator 760 can include a visual indicating device, such as a light-emitting diode (LED), which can selectively display two or more color signals (e.g., red, flashing red, green, and flashing green) to indicate the functional status of the data acquisition module 230. In other embodiments, other types of visual indicating devices, audible indicating devices (e.g., a beeper), and/or tactile indicating devices (e.g., a vibrator) can be used with the data acquisition module 230.

The data acquisition module housing 730 can carry a plurality of user interface devices for operating the weight pin 110. For example, the housing 730 can include an on/off switch or button 742 operably connected to the power switch 752 on the electronic circuitry 234. The housing 730 can also include a first record button 744*a*, a second record button 744*b*, and a reset button 746 which are operably connected to the microprocessor 750 and/or other associated features of the electronic circuitry 234. As described in greater detail below, the start record button 744*a* and the stop record button 744*b* can be used to control when the data acquisition module 230 records exercise data. In one embodiment, the reset button 746 can be used to calibrate the accelerometer 758 prior to an exercise set on a particular weight machine. In addition, the reset button 746 can also be used to calibrate the load sensor 224, reset the clock 756, and/or reset other data acquisition features of the electronic circuitry 234. The housing 730 can also include a lens or window 748 that provides visual access to the LED 760.

The user interface arrangement illustrated in FIG. 7 represents one possible user interface configuration. As those of ordinary skill in the art will appreciate, a data acquisition module and/or weight pin configured in accordance with the present invention can include other types of user interface devices in other arrangements. For example, in another embodiment, the data acquisition module 230 can include a display device, such as a display screen (e.g., an LCD display screen) for displaying various types exercise-related information to the user. Furthermore, in other embodiments one or more of the user interface devices shown in FIG. 7 can be omitted. For example, in another embodiment, a data acquisition module or weight pin configured in accordance with the present invention can include a single "on/off" button. In this embodiment, switching the on/off button to "on" automatically recalibrates, resets and/or initializes any or all of the electronic devices (e.g., the accelerometer 758, the load sensor 224, the clock 756, etc.) on the weight pin as needed to begin use.

In the illustrated embodiment, the data acquisition module 230 can be releasably attached to the handle portion 214 of the weight pin 110 via the electronic interface 232. The electronic interface 232 can include various types of known connectors for interchangeably coupling the data acquisition module 230 to various types of display devices (e.g., personal computers, cell phones, PDAs, etc.). For example, in one embodiment the electronic interface 232 can include a standard USB (universal service bus) port. In this embodiment, the data acquisition module 230 can include a male type-A USB connector for interfacing to a host computer or other data processing and/or display device. In this manner, the data acquisition module 230 can be releasably attached to the weight pin 110 prior to and during a workout session, and then detached from the weight pin 110 when the user desires to download the exercise data to a personal computer or other display device for viewing, monitoring progress, etc. In other embodiments, the data acquisition module 230 can be fixedly attached to the handle portion 214 or otherwise integrated into the weight pin 110. In these embodiments, the entire weight pin can be operably connected to a personal computer or other display device (by, e.g., a wire connection) to download the exercise data to the display device. In addition or alternatively, the exercise data can also be wirelessly transmitted from the weight pin 110 to the display device.

Figure 8A:
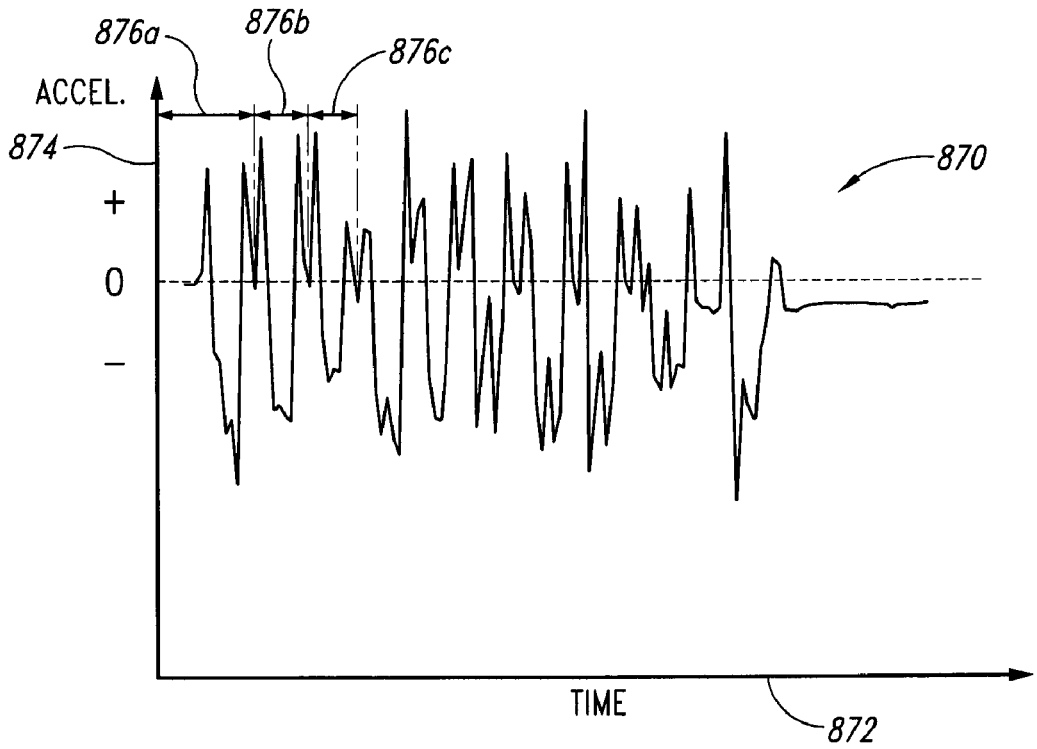
FIG. 8A is a plot of accelerometer data associated with use of an instrumented weight pin in accordance with an embodiment of the invention.
Figure 8B:
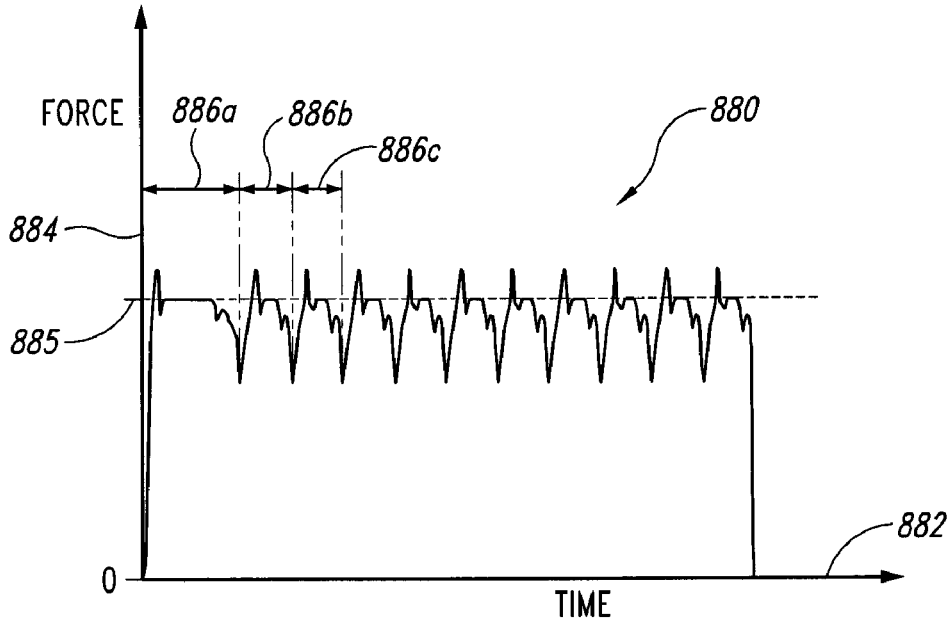
FIG. 8B is a corresponding plot of force sensor data associated with use of the instrumented weight pin.

FIG. 8A illustrates a plot 870 of accelerometer data, and FIG. 8B illustrates a plot 880 of corresponding force data, in accordance with embodiments of the invention. This data is illustrative of the various types of exercise-related data that can be processed and/or recorded by the data acquisition module 230 when the weight pin 110 (FIG. 2) is inserted in a weight stack during an exercise set. Referring first to FIG. 8A, acceleration is measured along a vertical axis 874, and time is measured along a horizontal axis 872. In the illustrated embodiment, the plot 870 graphically represents the acceleration detected by the accelerometer 758 (FIG. 7) as the weight stack moves up and down during an exercise set. For example, a first graph portion 876*a* corresponds to a first repetition of the exercise, a second graph portion 876*b* corresponds to a second repetition of the exercise, and so on.

In FIG. 8B, force is measured along a vertical axis 884, and time is measured along a horizontal axis 882. In this embodiment, the plot 880 graphically represents the force detected by the sensor assembly 220 (FIG. 7 and others) as the weight stack moves up and down during the exercise set, with a horizontal line 885 representing the selected weight for the exercise set. For example, a first graph portion 886*a* corresponds to the first repetition of the exercise, a second graph portion 886*b* corresponds to a second repetition of the exercise, and so on.

The plots shown in FIGS. 8A and 8B are provided for purposes of illustration only, and are not meant to be definitive versions of the data collected by the data module 230 during any particular type of exercise. Accordingly, the actual force and acceleration data collected during a particular exercise will vary depending on a number of factors including, for example, the type of weight machine, the amount of weight selected, the user, etc.

Figure 9:
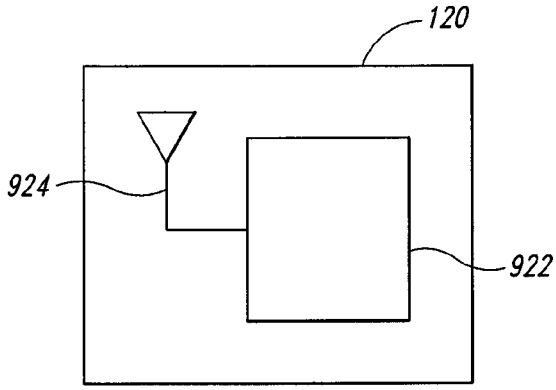
FIG. 9 is a schematic diagram of an exercise machine information unit configured in accordance with an embodiment of the invention.

FIG. 9 is a schematic diagram of the machine information unit 120 ("information unit 120") of FIG. 1, configured in accordance with an embodiment of the invention. In the illustrated embodiment, the information unit 120 can include a passive RFID device with a transponder tag 922 (e.g., an RFID processor or chip) operably connected to an antenna 924. Various types of machine-related information can be programmed into the transponder tag 922. The information can include, for example, information that identifies the particular type of exercise machine (e.g., a bench press, leg press, etc.). In addition, the information can also include various machine-specific parameters such as seat height settings, seatback angle settings, bar settings, and/or other machine-related settings. The information can also include machine-specific formulas and/or routines that, when transmitted to the data acquisition module 230, enable the data acquisition module 230 to convert raw force sensor data from the sensor assembly 220 into actual exercise weights.

In another embodiment, machine specific parameters (e.g., seatback angle, bar placement, and/or machine-specific factors for converting force sensor data, accelerometer data, etc. into useful workout information) for one or more weight machines can be stored in the data acquisition module memory 754 (FIG. 7). In this embodiment, the data acquisition module 230 can automatically retrieve the parameters for a particular weight machine from the memory 754 once it receives machine identification information from the machine information unit 120 (or from manual user input).

Although a passive RFID tag is illustrated in FIG. 9, in other embodiments, other types of RFID devices and/or other types of short-range wireless and wired communication devices can be included with the machine information unit 120. For example, in another embodiment, the information unit 120 can include an active RFID tag, a barcode for use with an infrared reader incorporated into the data acquisition module 230, etc.

Figure 10:
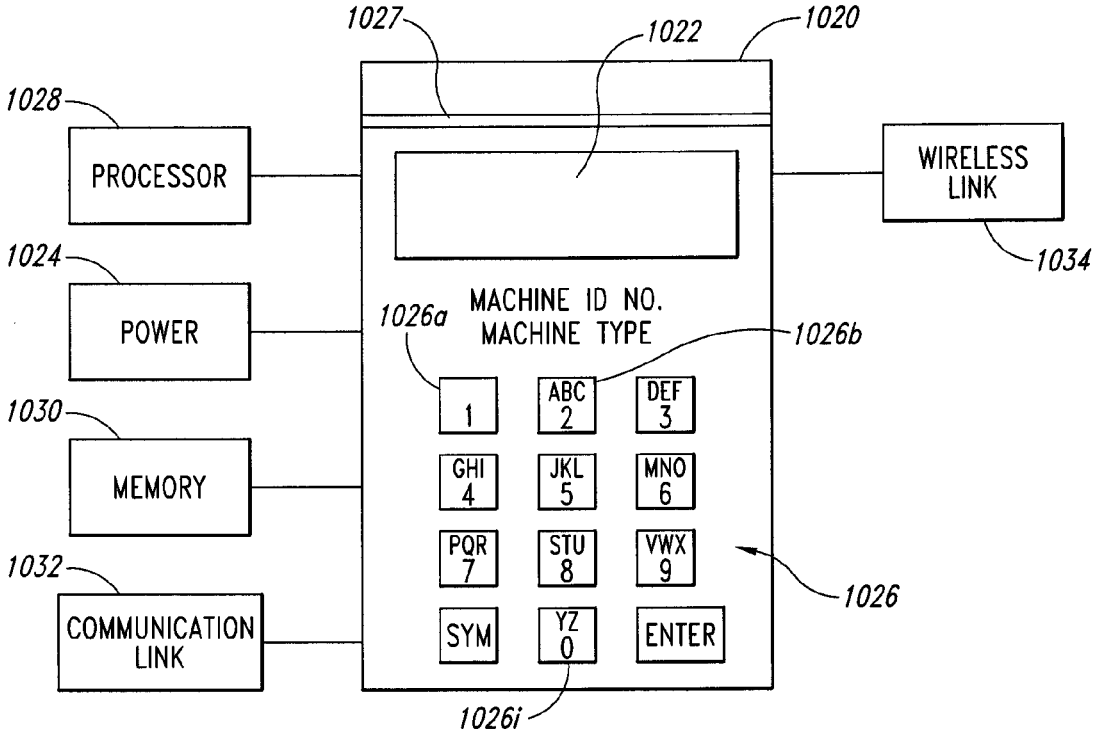
FIG. 10 is a schematic diagram of an exercise machine information unit configured in accordance with another embodiment of the invention.

FIG. 10 is a schematic diagram of a machine information unit 1020 ("information unit 1020") configured in accordance with another embodiment of the invention. The information unit 1020 can be affixed (e.g., by adhesive bonding) to an exercise machine (e.g., the exercise machine 101 of FIG. 1), or positioned at least proximate to a particular exercise machine in a gym or other workout area. The information unit 1020 can include a display screen 1022 (e.g., a digital display screen) for displaying textual information, and a user interface 1026. The user interface 1026 can include, for example, a key pad or touch pad having a plurality of alphanumeric keys 1026*a-i*. In another embodiment, the information unit 1020 can include a card reader 1027 for reading, e.g., user information off a magnetic strip (or other data storage media) on a wallet-size card or other device.

The information unit 1020 can also include a processor 1028 that controls operation of the information unit 1020 in accordance with computer-readable instructions stored in memory 1030. The processor 1020 can be operably connected to a power source 1024, a wired communication link 1032, and/or a wireless communication link 1034. In the illustrated embodiment, the processor 1024 can use either of the communication links 1032 or 1034 to receive information from and/or provide information to the data acquisition module 230 on the weight pin 110 (FIGS. 2, 7 and others). In other embodiments, the information unit 1020 can include other media for uploading information to the data acquisition module 230. Such media can include, for example, a magnetic stripe or barcode (not shown) that contains, e.g., exercise machine information. In these embodiments, the data acquisition module 230 can include a magnetic stripe reader and/or a barcode reader to read information off the magnetic stripe and/or barcode, respectively.

The information unit 1020 can be used in a number of ways in accordance with various embodiments of the invention. For example, in one embodiment, a user can input a password, PIN, or other form of ID via the user interface 1026 and/or the card reader 1027. In response to receiving the information, the information unit 1020 can retrieve information related to the user and present it on the display screen 1022. The information can include, for example, prior workout information, reminders about particular exercise routines, suggested weights and/or number of repetitions, and other useful user information. This user information can be retrieved from memory 1030, or retrieved from a network source (e.g., a server computer) via the wired link 1032 and/or the wireless link 1034. In one embodiment, this information can be transmitted to the data acquisition module 230 via the wired communication link 1032 or the wireless communication link 1034. The data acquisition module 230 can store this information for later download to a user computer or other display device.

In another embodiment, the user can input various types of workout related information via the user interface 1026. The information can include, for example, personal information (e.g., name, body weight, age, sex, etc.), and/or machine settings for a particular exercise (e.g., seat settings, weight values, etc.). The information can also include the date, time of day, etc. (alternatively, the information unit 1020 can provide this information via an associated clock). The information unit 1020 can store this information in memory 1030 for later use, display this information for viewing by the user, and/or transmit this information to the data acquisition module 230 via either the wired communication link 1032 or the wireless communication link 1034. The data acquisition module 230 associates this information with the load and/or acceleration data collected by the weight pin 110 during use of the particular weight machine, and stores this information for later download to a user computer or other display device.

In a further embodiment, the user can upload information from the weight pin 110 to the information unit 1020 via either the wired communication link 1032 or the wireless communication link 1034. The information can include, for example, personal information (e.g., name, body weight, age, sex, etc.), prior workout history, new workout parameters, etc. The information can also include the date, time of day, etc. The information unit 1020 can store this information in memory 1030 for later use, and/or display all or a portion of this information for viewing by the user. The information unit 1020 can also use this information to generate other useful information that can be transmitted back to the data acquisition module 230 via either the wired communication link 1032 or the wireless communication link 1034. The data acquisition module 230 can store this information for later download to a user computer or other display device.

Figure 11:
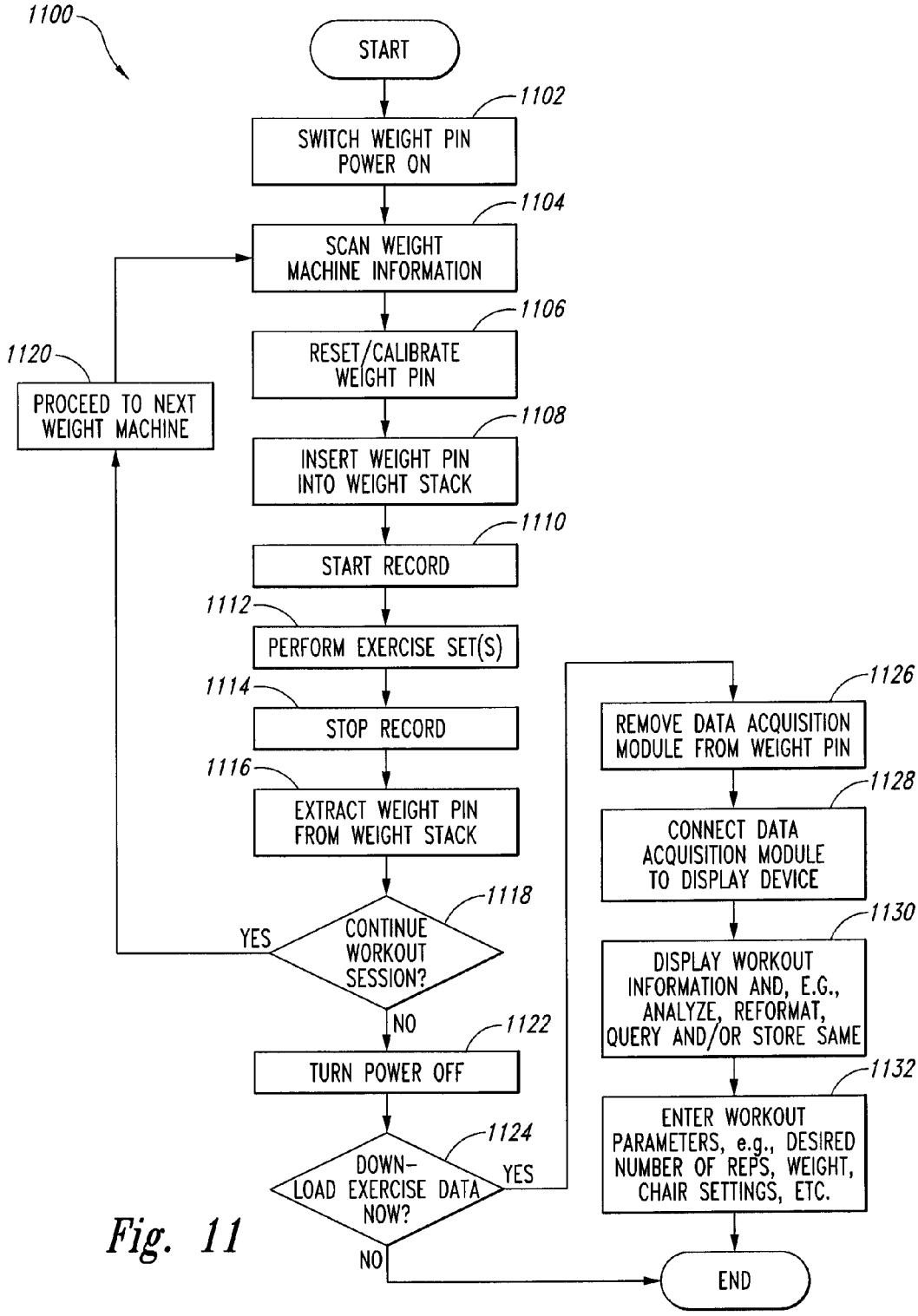
FIG. 11 is a flow diagram of a method of using an instrumented weight pin in accordance with an embodiment of the invention.

FIG. 11 is a flow diagram of a routine 1100 for using an instrumented weight pin (e.g., the instrumented weight pin 110, 510, or 610 described above) in accordance with an embodiment of the invention. In this embodiment, at least a portion of the routine 1100 can be performed by a user (e.g., the user 106 of FIG. 1) to record information relating to his or her exercise program as he or she moves around a gym using one or more different weight machines. For ease of reference, one or more steps of the routine 1100 are described below with reference to the instrumented weight pin 110 of FIG. 2 and/or the data acquisition module 230 of FIG. 7.

In block 1102, the user turns the weight pin power "on." In the embodiment of FIG. 7, the user can perform this operation by depressing the on/off switch 742 on the data acquisition module 230. In one embodiment, the indicator 760 can indicate the power is "on" by showing a flashing red light that is visible to the user through the window 748 on data acquisition module cover 732*a*. In block 1104, the user scans the weight machine information unit (e.g., the weight machine information unit 120 of FIGS. 1 and 9; or the weight machine information unit 1020 of FIG. 10) with the data acquisition module 230 to download information about the weight machine. As described above, in one embodiment, the user can do this by waving the weight pin 110 in close proximity to the weight machine information unit so that the wireless transceiver 762 (FIG. 7) on the data acquisition module 230 can read the information from the machine information unit. In other embodiments, the user can download information from the weight machine to the data acquisition module 230 using other communication facilities or by direct user input. For example, the information could be input by scanning a barcode, by manual input via a key pad or other user interface on the data acquisition module 230, etc. As described in detail above with reference to, e.g., FIG. 10, in still further embodiments, the user can upload information (e.g., user information, weight machine information, etc.) at this time from the data acquisition module 230 to the machine information unit via the transceiver 762. In those embodiments in which the weight machine does not include a machine information unit, or the user does not need or want to record information about the weight machine, this step of block 1104 can be omitted.

In block 1106, the user resets the weight pin 110. In one embodiment, this step can be accomplished by depressing the reset button 746 on the data acquisition module 230 shown in FIG. 7. When this button is depressed, the accelerometer 758 (and/or the load sensor 224) is "reset" or initialized to a baseline (e.g., a "zero" acceleration) setting. Once the accelerometer 758 has been reset, the indicator 760 can show, e.g., a "solid" (i.e., non-flashing) red light through the window 748 to indicate to the user that the weight pin 110 is ready for use. In other embodiments, the accelerometer 758, the load sensor 224, and/or the other electronics on the weight pin 110 will not need to be reset or recalibrated, and this step can be optional or omitted.

In block 1108, the user inserts the weight pin 110 into the weight stack to select a desired exercise weight. In block 1110, the user depresses the start record button 744*a* to begin recording data associated with the exercise set. In one embodiment, the indicator 760 can show a solid green light to indicate to the user that the data acquisition module 230 is now ready to receive data. In other embodiments, the step of depressing the start record button 744*a* can be omitted, and the data acquisition module 230 can be configured to begin receiving exercise data as soon as the device is turned on or otherwise powered-up.

In block 1112, the user performs an exercise set. For ease of reference, the words "exercise set" as used herein can refer to the one or more consecutive repetitions of an exercise performed on particular weight machine at a particular weight setting. By way of example, 10 consecutive repetitions of a lifting exercise on a particular weight machine (e.g., a shoulder press) at a 50 lb setting would be a first exercise set, while 5 consecutive repetitions at a different setting, e.g., 70 lbs, would be a second exercise set.

At one or times during or after the exercise set, the indicator 760 can switch from a solid green light to, e.g., a flashing green light to indicate to the user that the device is actively storing exercise data in memory. In block 1114, once the user has completed the exercise set, the user depresses the stop record button 744*b*. At this time, the indicator 760 can return to a solid red light to indicate to the user that the power is on but the device is not in the "record" mode. In other embodiments, the step of depressing the stop record button 744*b* can be omitted, and the data acquisition module 230 can be configured to automatically go to a "standby" mode when it detects a lack of movement and/or load for a predetermined period of time. In block 1116, the user extracts the weight pin 110 from the weight stack.

In decision block 1118, the user decides if he or she wishes to continue working out. If so, the user proceeds to the next weight machine as indicated by block 1120, and repeats the routine 1100 starting at block 1104. If the user is done with his or her workout, the user can turn the device power off, as shown in block 1122. In other embodiments, the step of turning the power off can be omitted, and the data acquisition module 230 can be configured to automatically shut down or power off when it detects a lack of use for a predetermined period of time.

In decision block 1124, the user determines if he or she wishes to download the exercise data stored in the data acquisition module 230. If the user does not wish to download the exercise data at this time, the routine ends. If the user does wish to download the exercise data to assess his or her progress, view information relating to the exercise session and/or prior sessions, etc., the user can disconnect the data acquisition module 230 from the weight pin 110, as shown in block 1126. As shown in block 1128, the user then connects the data acquisition module 230 to a suitable display device (e.g., a user computer, PDA, cell phone, specialized computer kiosk, etc.) via the electronic interface 232. Alternatively, in those embodiments in which the data acquisition module 230 is not removable from the weight pin 110 (or optionally removable from the weight pin 110), the step of block 1126 can be omitted and the data acquisition module 230 can be operably connected to a user computer or other display device using other wired and wireless means.

In block 1130, the user operates the display device to display all or a portion of the downloaded workout information for viewing. As described in greater detail below, various embodiments of the present invention are directed to software routines for presenting the workout information in various forms, including graphs, spreadsheets, bar charts, and other user-friendly formats. In addition, other embodiments of the invention are directed to software routines for compiling the workout information or otherwise processing it so that users can monitor their progress and track other parameters relating to their exercise programs.

In block 1132, the user can enter information into the display device for storage in associated memory or transfer to the data acquisition module 230. The information can include, for example, information for future workouts (e.g., desired machines, desired weight settings and/or number of repetitions, etc.) and/or personal information (e.g., name, weight, age, etc.). In one embodiment, this information can be uploaded onto the data acquisition module 230, and then transmitted to a machine information unit (e.g., the machine information unit 1020 of FIG. 10) at a later time for data processing and/or display. In addition or alternatively, this information can also be stored in the data acquisition module 230 and used by the device to process exercise-related data received via the instrumentation (e.g., the load sensor, accelerometer, etc.) carried by the device.

Figure 12:
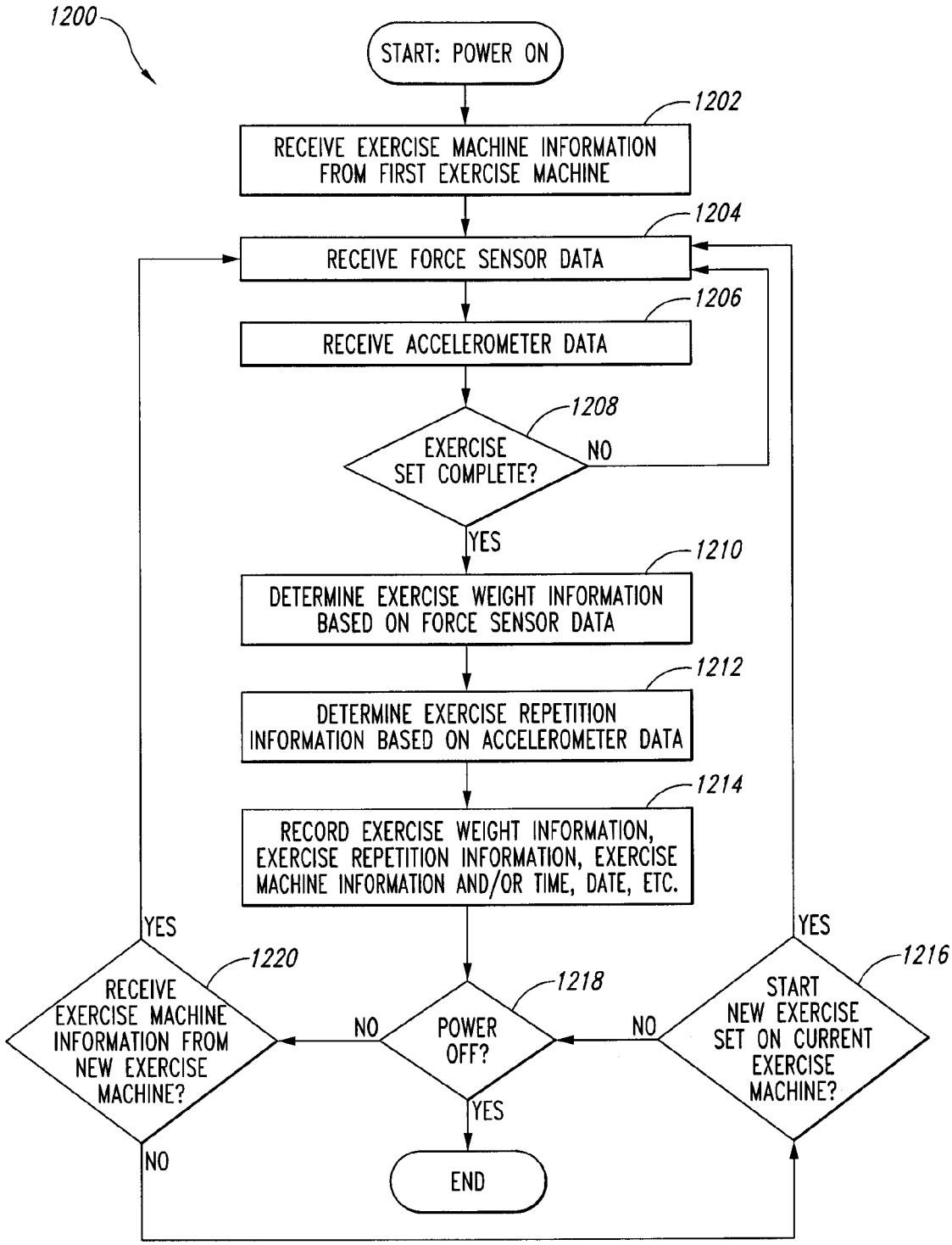
FIG. 12 is a flow diagram of a routine for processing weight pin data in accordance with an embodiment of the invention.

FIG. 12 is a flow diagram of a routine 1200 for processing information received by an instrumented weight pin or other exercise data acquisition device in accordance with an embodiment of the invention. In one embodiment, all or part of the routine 1200 can be performed by the data acquisition module processor 750 of FIG. 7, in accordance with computer-readable instructions stored on associated memory (e.g., the memory 754). In block 1202, the routine receives exercise machine information. The exercise machine information can include, for example, information identifying the type, location, etc. of a particular exercise machine, as well as other information relating to the configuration of the machine (e.g., seat position, seat angle, etc.). In block 1204, the routine receives force sensor data. In one embodiment, for example, the routine receives the force sensor data from the sensor assembly 220 (FIGS. 2-5C) during an exercise set. In block 1206, the routine receives accelerometer data. In one embodiment, for example, the routine receives the accelerometer data from the accelerometer 758 (FIG. 7) during the exercise set.

In decision block 1208, the routine determines if the exercise set is complete. In one embodiment, the routine can make this determination based on manual input from the user (e.g., the user depresses a stop record button on the data acquisition module 230) indicating that he or she is done with the exercise set. In another embodiment, the routine can make this determination automatically based on a predetermined period of inactivity (e.g., 1 minute) as indicated by, e.g., a lack of accelerometer data. If the exercise set is not complete, the routine returns to block 1204 and repeats.

Conversely, if the exercise set is complete, the routine proceeds to block 1210 and determines exercise weight information based at least in part on the force sensor data. For example, the routine can determine the selected exercise weight with "raw" force sensor data by using conversion formulas associated with the particular exercise machine. In block 1212, the routine determines exercise repetition information based on the accelerometer data. For example, the routine can utilize the accelerometer data to determine the number of times the weight stack went up and down during the exercise set. In block 1214, the routine can record the weight information, the repetition information, the exercise machine information, and/or other information associated with the exercise set such as the date, time, etc.

In decision block 1218, the routine checks for power. If the device power is "off," the routine ends. If the device power is "on," the routine proceeds to decision block 1220 and checks for information from a new exercise machine. Here, the information can include machine identification information associated with a second weight machine the user wishes to use. If the routine receives information from a new weight machine, the routine returns to block 1204 and repeats for the new exercise machine. If not, the routine proceeds to decision block 1222 and determines if the user has started a new exercise set on the current weight machine. In one embodiment, the routine can make this determination based on one or more signals received from the sensor assembly 220 and/or the accelerometer 758 of FIG. 7 indicating a new exercise set has begun. If a new exercise set has begun, the routine returns to block 1204 and repeats. If not, the routine returns to decision block 1218 and repeats.

In the embodiment of FIG. 12, the data acquisition module on the weight pin processes the "raw" sensor and/or accelerometer data to determine, e.g., exercise weight information and/or exercise repetition information. This information can then be downloaded to a user computer or other suitable display device for viewing and/or further processing. As those of ordinary skill in the art will appreciate, however, in other embodiments, the data acquisition module can simply record the raw sensor and/or accelerometer data. When this data is later downloaded to the user computer or other display device, the display device can process the data to determine the exercise weight and/or repetition information. Thus, the various processing steps can be allocated between the data acquisition module and the display device as desired depending on the particular situation.

Figure 13:
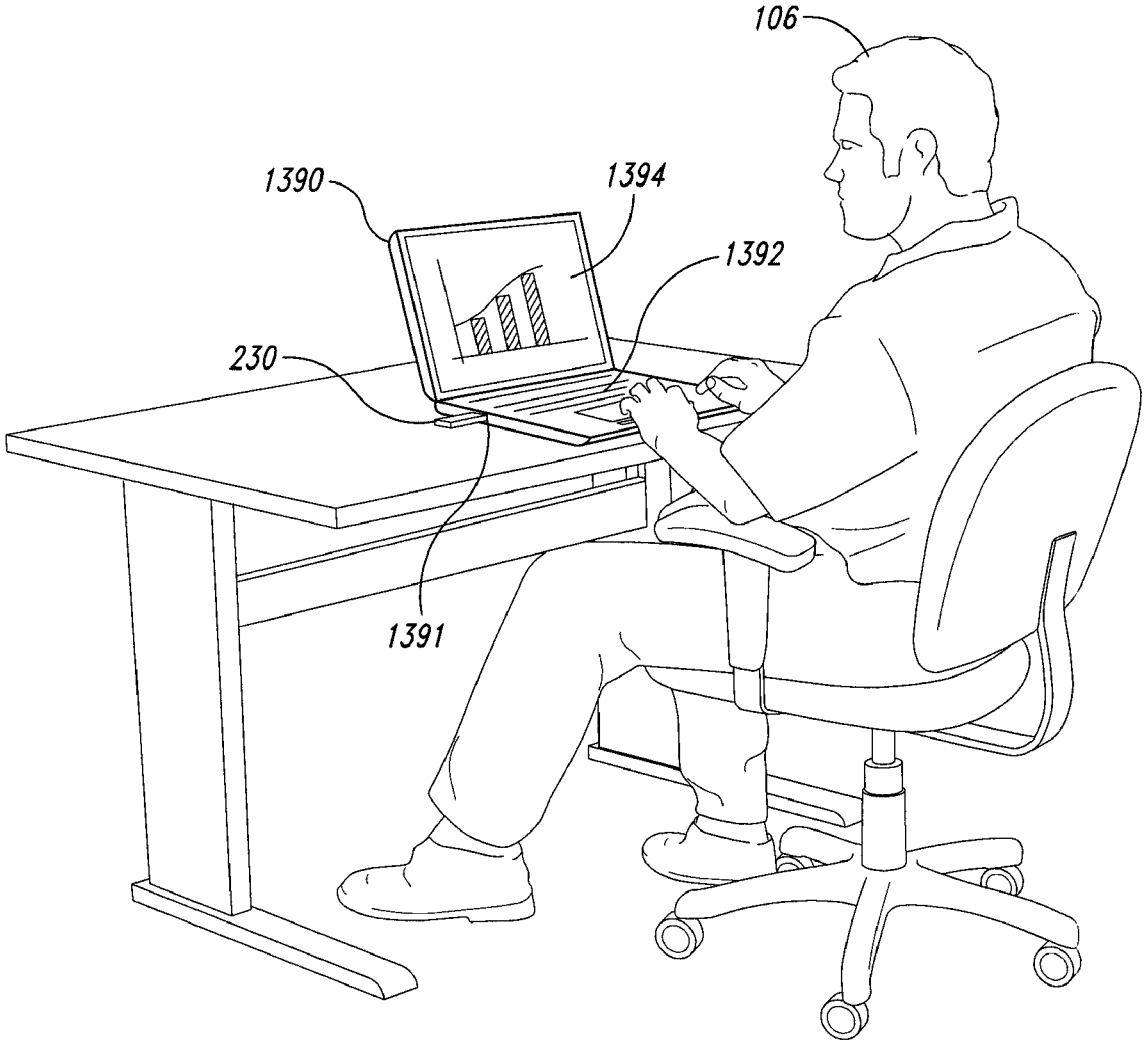
FIG. 13 is an isometric view of an exercise information display device configured in accordance with an embodiment of the invention.

FIG. 13 is an isometric view showing the data acquisition module 230 (FIG. 7) operably coupled to a display device or user computer 1390 in accordance with an embodiment of the invention. The user computer 1390 can be a personal computer or workstation (e.g., a laptop computer, a desktop computer, etc.), a specialized computer, or other suitable display device (e.g., PDA, cell phone, etc.) having one or more processors (not shown) that execute computer-readable instructions to display and/or process information received from the data acquisition module 230 and/or the user 106. Thus, although the user computer 1390 is shown in FIG. 13 for purposes of illustration, virtually any type of processing device having suitable display capabilities can be used in accordance with the present invention.

The user computer 1390 can include one or more user input devices 1392, and one or more data storage devices (not shown). The user input devices can include a keyboard and/or a mouse or other pointing device. Other input devices are possible such as a microphone, joystick, pen, game pad, scanner, digital camera, video camera, and the like. The data storage devices can include any type of computer-readable media that can store data accessible by the user computer 1390, such as magnetic hard and floppy disk drives, optical disk drives, magnetic cassettes, tape drives, flash memory cards, digital video disks (DVDs), Bernoulli cartridges, RAMs, ROMs, smart cards, etc. Indeed, any medium for storing or transmitting computer-readable instructions and data may be employed, including a connection port to a network such as a local area network (LAN), wide area network (WAN) or the Internet (not shown in FIG. 13). The user computer 1390 can also include at least one output device such as a display screen 1394, and/or one or more optional output devices not shown (e.g., printer, plotter, speakers, tactile or olfactory output devices, etc.). In addition, the user computer 1390 may be operably coupled to one or more remote or external computers, such as via an optional network connection, a wireless transceiver, etc.

In the illustrated embodiment, the user 106 inserts the data acquisition module 230 into an electronic interface 1391 (e.g., a USB port) on the user computer 1390 to download and display exercise data on the display screen 1394. As described in greater detail below, various embodiments of the invention include computer software and other computer-readable instructions configured to cause the user computer 1390 to display the exercise data in various forms that enable a user to monitor training progress and/or perform other useful functions with the exercise data. For example, the exercise data can be stored on the user computer 1390 and compiled so that the user can track his or her weight training performance over time and analyze their workout regimen for possible changes.

FIGS. 14A-14D illustrate a series of display pages 1400 (identified individually as display pages 1400*a-d*, respectively) configured in accordance with embodiments of the invention. The display pages 1400 illustrate some of the ways in which the exercise data collected by the instrumented weight pin 110 described in detail above can be displayed on the user computer 1390 of FIG. 13. For example, in FIG. 14A, exercise repetitions are measured on a vertical axis 1402*a*, and the date of the exercise session is indicated along a horizontal axis 1404*a*. Accordingly, a data plot 1406*a* provides a graphical illustration of the number of repetitions the user performed on a particular weight machine (e.g., a vertical press) on a particular day.

Figure 14A:
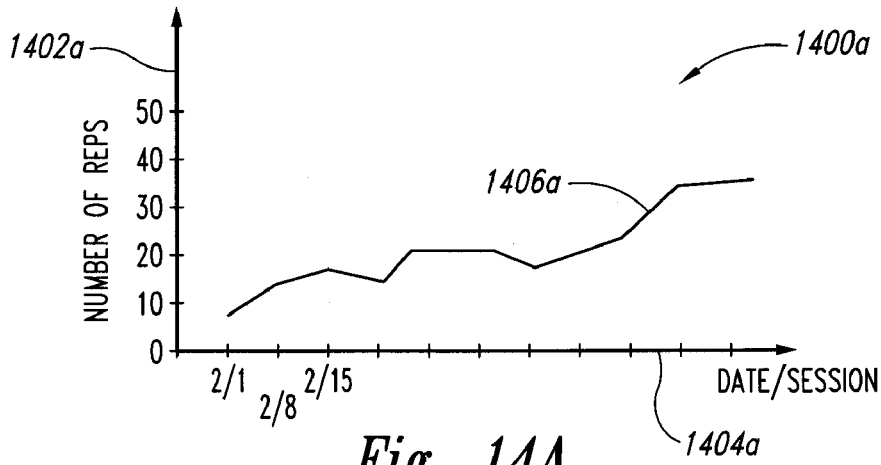
FIGS. 14A-14D are a series of display descriptions illustrating various types of exercise-related information in accordance with embodiments of the invention.
Figure 14B:
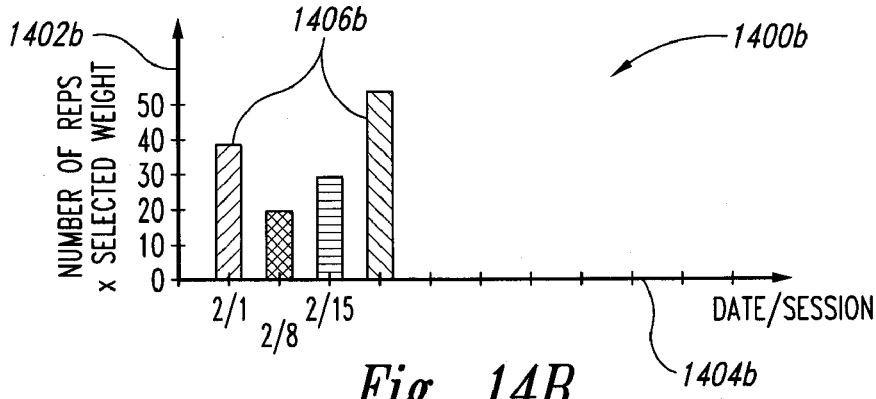

Referring next to FIG. 14B, total weight of an exercise set (i.e., repetitions×selected weight) is measured along a vertical axis 1402*b*, and the date is indicated along a horizontal axis 1404*b*. Accordingly, a bar graph 1406*b* indicates the total weight the user lifts on a particular day.

Figure 14C:
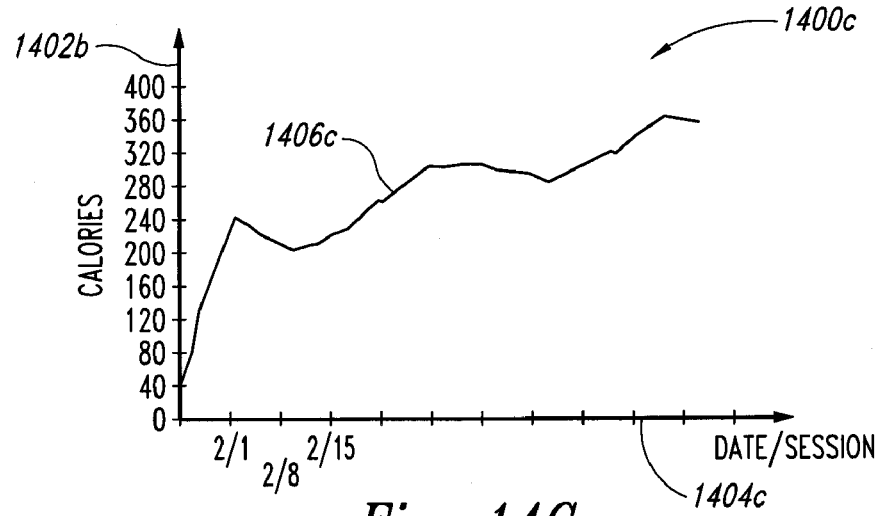

Turning next to FIG. 14C, calories are measured along a vertical axis 1402*c*, and the date is indicated along a horizontal axis 1404*c*. Here, a plot 1406*c* illustrates the amount of calories burned up by the user on a given date on one or more particular exercise machines.

Figures 14D, 15A, 15B:
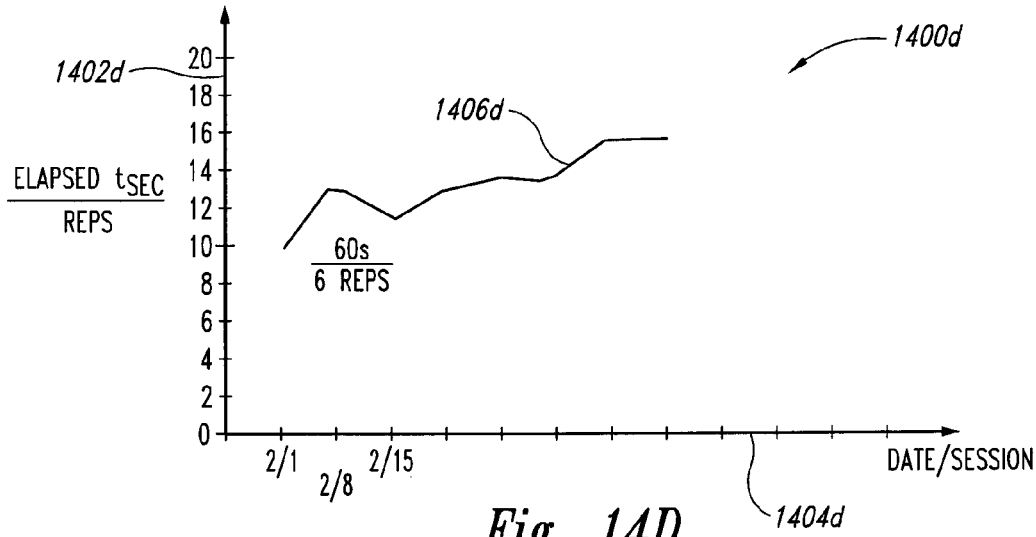
FIGS. 15A and 15B illustrate two possible database structures containing exercise-related information in accordance with embodiments of the invention.

Referring next to FIG. 14D, the time-per-repetition for a particular exercise is indicated along a vertical axis 1402*d*, and the date is indicated along a horizontal axis 1404*d*. For example, if the user did six repetitions of a particular exercise in one minute on a given day, this would equate to ten seconds per repetition. Accordingly, a plot 1406*d* indicates the average time-per-repetition on the listed dates.

FIGS. 15A and 15B illustrate two possible spreadsheet displays 1500*a* and 1500*b*, respectively, for presenting exercise data in accordance with embodiments of the invention. In FIG. 15A, the date of the exercise session is shown in column 1510*a*, the exercise machines used on that date are shown in column 1512*a*, and the various machine settings (e.g., seat settings), if applicable, are shown in column 1514*a*. The display page 1500*a* can also include the exercise weight in column 1516*a*, the number of repetitions in column 1518*a*, the elapsed time of the exercise set in column 1520*a*, and the calories burned in column 1522*a*. On October 21, for example, the display page 1500*a* illustrates that the user did three different exercise sets on two different machines (i.e., the #2 press machine and the #1 leg machine).

The spreadsheet display 1500*b* shown in FIG. 15B can include information that is similar to that shown in FIG. 15A, but instead of presenting data for each individual exercise set, the data can be provided in totals. For example, each of the machines used on, e.g., October 21 can be shown in column 1512*b*, the total calories burned on that date can be shown in column 1514*b*, and the total time of the exercise session can be shown in column 1516*b*.

The display pages shown in FIGS. 14A-15B illustrate but a few of the possible display pages that can be created using the exercise data downloaded from the data acquisition module 230. Accordingly, those of ordinary skill in the art will appreciate that there are virtually limitless ways to present this data in a usable fashion. Therefore, those of ordinary skill in the art will also appreciate that the present invention is not limited to the particular display pages described herein, but can extend to myriad other display pages configured in accordance with the present disclosure.

Figure 16A:
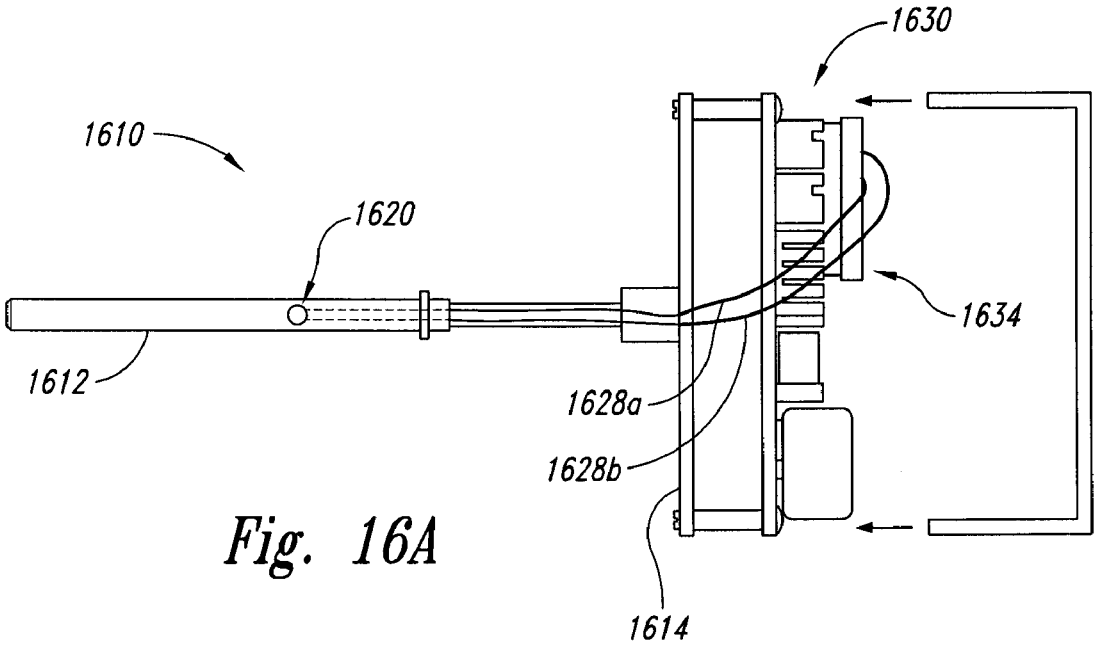
FIG. 16A is a top view of an instrumented weight pin configured in accordance with another embodiment of the invention.
Figure 16B:
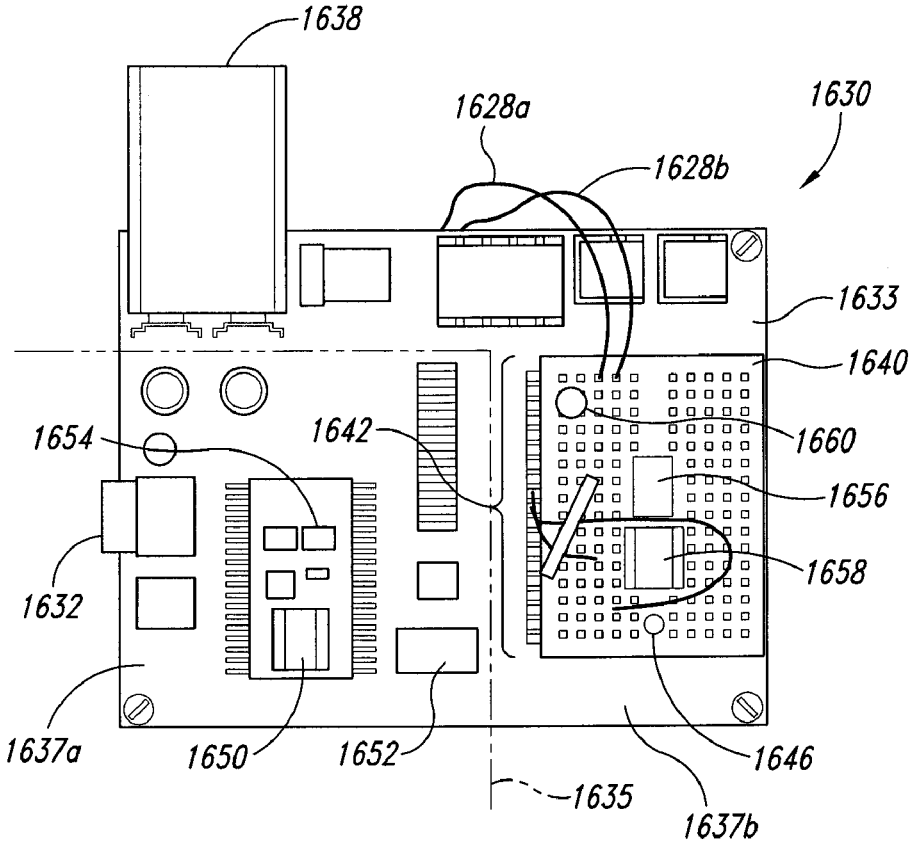
FIG. 16B is an end view of the instrumented weight pin of FIG. 16A illustrating an associated data acquisition module.

FIG. 16A is a top view of an instrumented weight pin 1610 configured in accordance with another embodiment of the invention, and FIG. 16B is a corresponding end view of the weight pin 1610. Referring first to FIG. 16A, the weight pin 1610 of the illustrated embodiment includes many features that are at least generally similar in structure and function to the weight pin 110 described above with reference to FIGS. 1-5C, 7, etc. For example, the weight pin 1610 includes a shaft portion 1612 that extends outwardly from a handle portion 1614. The shaft portion 1612 carries a sensor assembly 1620 (that includes, e.g., a Flexiforce compression sensor from Tekscan, No. A-201-100) that is operably connected to a data acquisition module 1630 by data links 1628 (identified individually as a first link 1628*a* and a second link 1628*b*). The data acquisition module 1630 can include electronic circuitry 1634 as described in detail below with reference to FIG. 16B.

As shown in FIG. 16B, the electronic circuitry 1634 is mounted to a printed circuit board 1633. A power source 1638 (e.g., a 9-volt battery, a lithium button-cell battery, etc.) provides power to the electronic components on the printed circuit board 1633. As with the data acquisition module 230 described above with reference to, e.g., FIG. 7, the data acquisition module 1630 can also record data associated with an exercise set when the shaft portion 1612 of the weight pin 1610 is inserted into a weight stack. To perform these functions, the data acquisition module 1630 can include a microprocessor 1650 (e.g., a Paralax BS2 Rev G microprocessor) operably coupled to memory 1654 (e.g., 2K EEPROM non-volatile memory).

The data acquisition module 1630 can further include a real-time clock 1656 (e.g., a Dallas semiconductor DS 1302 clock) and an accelerometer 1658 (e.g., a Memsic 2125 accelerometer) mounted to a breadboard 1640. A series of microcontroller pins 1642 operably connect the devices mounted on the breadboard 1640 to the microprocessor 1650. The microprocessor 1650 can execute computer-readable software instructions stored on microcontroller memory to process real-time data received from the sensor assembly 1620, the clock 1656, and the accelerometer 1658 to determine various parameters associated with an exercise set when the shaft portion 1612 of the weight pin 1610 is operably inserted into a corresponding weight stack. The data acquisition module 1630 can also include a reset button 1646 and an indicator 1660 (e.g., an LED) for resetting the data acquisition module 1630 and indicating various functional modes, respectively. To download data from the data acquisition module 1630, the data acquisition module 1630 can be operably coupled to a user computer or other suitable display device via a suitable electronic interface 1632 (e.g., a USB port). There are numerous ways to package the data acquisition module components shown in FIGS. 16A and 16B, and the illustrated embodiment represents but one example. In another embodiment, the printed circuit board 1633 can be separated along a phantom line 1635 into a first portion 1637*a* and a second portion 1637*b*. In this embodiment, the breadboard 1640 (and the components mounted to it) and one or more of the other components mounted on the second portion 1637*b* of the printed circuit board 1633 (e.g., the power source 1638) can be positioned beneath the first portion 1637*a*. "Stacking" the components in this manner may provide a more efficient data acquisition module package that is smaller than the configuration illustrated in FIGS. 16A and 16B.

Figure 17:
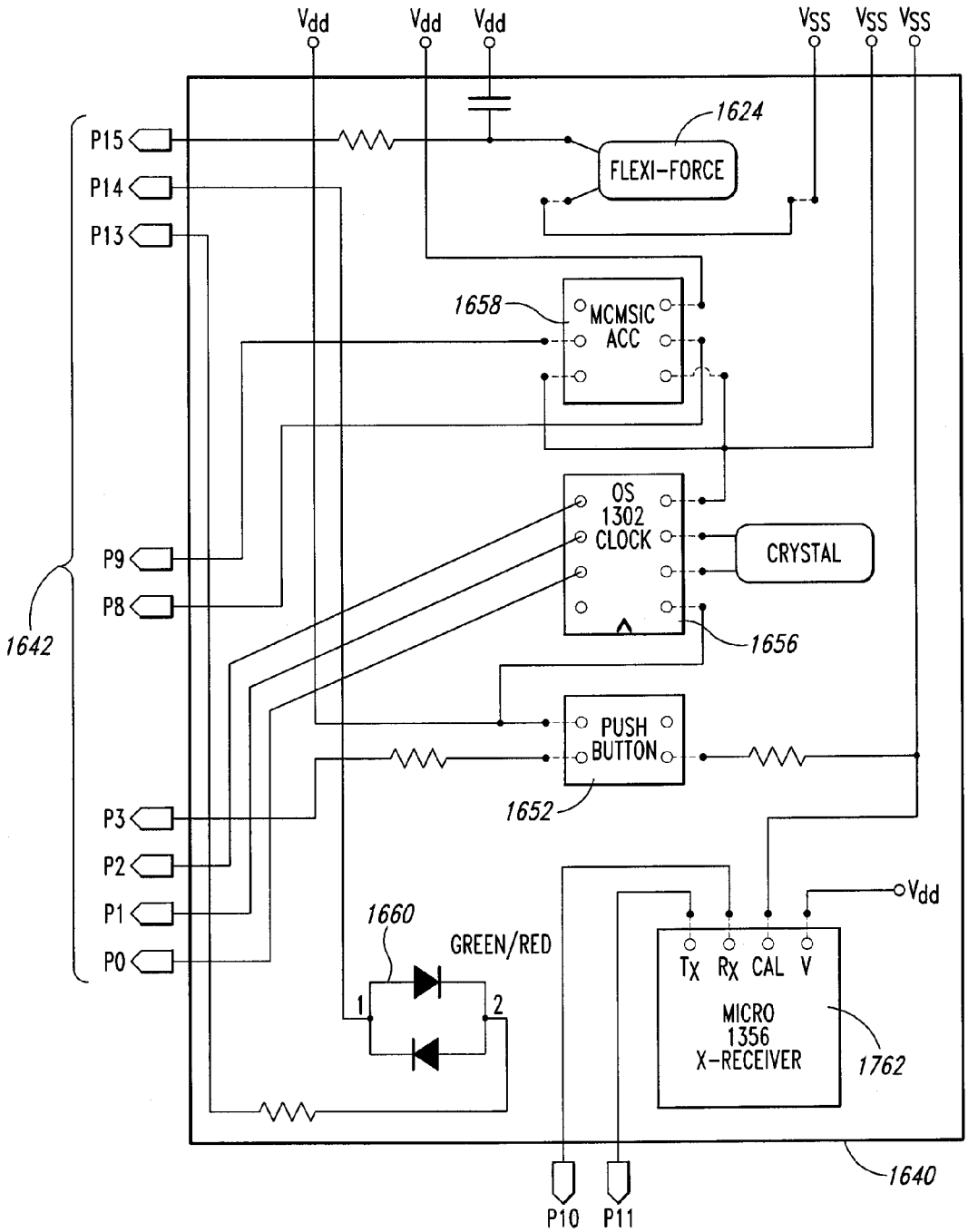
FIG. 17 is a schematic diagram of a portion of a data acquisition module configured in accordance with an embodiment of the invention.

FIG. 17 is a schematic diagram of the breadboard 1640 of FIG. 16B, configured in accordance with an embodiment of the invention. In FIG. 17, the connections $V_{DD}$ indicate high voltage connections to the power source 1638 (FIG. 16B), and the connections $V_{SS}$ indicate ground connections. Furthermore, the connections P0-P15 represent the microcontroller pins 1642 which communicate information from the electronic devices mounted on the breadboard 1640 to the microprocessor 1650 (FIG. 16B).

A number of electronic components can be mounted to the breadboard 1640. These components include, for example, the accelerometer 1658, the clock 1656, the on-off switch 1652, and the indicator 1660. In addition, a transceiver 1762 (e.g., a JagSense, micro 1356 miniature RF reader) can also be mounted to the breadboard 1640. As those of ordinary skill in the art will appreciate, the schematic diagram of FIG. 17 illustrates one possible configuration of the breadboard 1640. Accordingly, a number of other arrangements of electronic components can be used to provide a data acquisition module in accordance with the present invention.

Although the foregoing discussion describes instrumented weight pins and associated circuitry for use with stacked weight exercise machines, in other embodiments of the present invention, the various data acquisition devices described herein can be used to receive and record information relating to other types of physical exercise. For example, in other embodiments, a user doing chin-ups or similar exercises that include repetitive motions, can carry an instrumented weight pin as described herein (or, just a data acquisition module as described herein) on his or her person. As the user performs the chin-ups, the data acquisition module can record the number of times the person goes up and down. This information can later be downloaded to a personal computer or other display device so that the user can view the information. Similarly, a user doing sit-ups can hold the data acquisition module in his or her hands as he or she is doing the exercise, and thereby record the number of sit-ups performed. The data acquisition module (either coupled or uncoupled to the weight pin) can be used in a similar manner to record, e.g., push-ups, jumping jacks, etc.

Accordingly, the instrumented weight pins and/or the data acquisition modules described herein can be used in a number of different ways to receive, record, and/or display information relating to physical exercises. Furthermore, the various devices described herein have a wide range of uses that include exercise applications outside of the conventional stacked weight exercise machine context. In these other embodiments, the load sensors discussed above may not be necessary, as the accelerometer alone may be sufficient to detect the necessary user motions. For example, in one embodiment, a data acquisition module as described above that is not connected to a load sensor can be carried in the user's pocket or clipped to a user's workout belt during an exercise session to record the number of repetitive movements the user performs during an exercise (e.g., during a set of chin-ups, sit-ups, jumping jacks, and/or other calisthenics, etc.). In addition or alternatively, the data acquisition module can be carried on a wrist band to record the number of free weight movements (e.g., bench press, curls, etc.) the user performs.

Figure 18A:
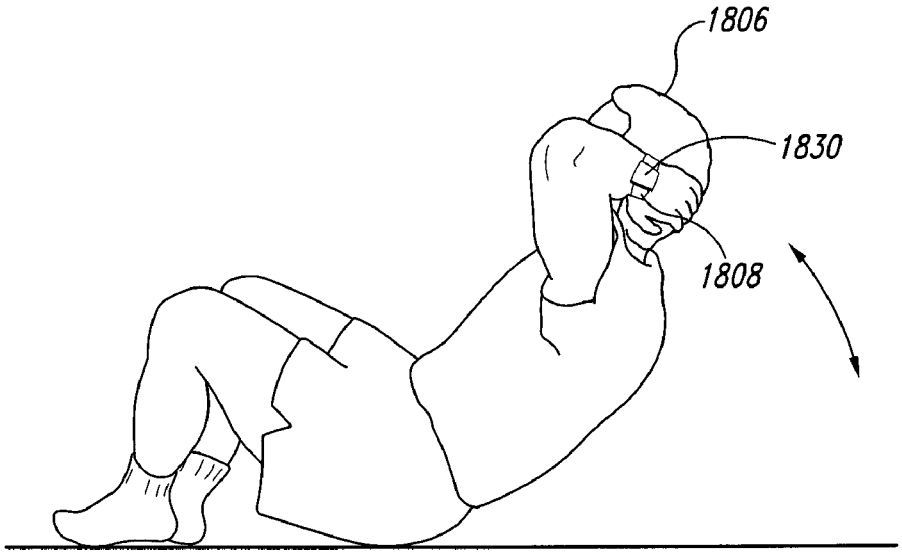
FIGS. 18A and 18B are isometric views of a person recording information relating to physical exercise with a data acquisition module configured in accordance with an embodiment of the invention.
Figure 18B:
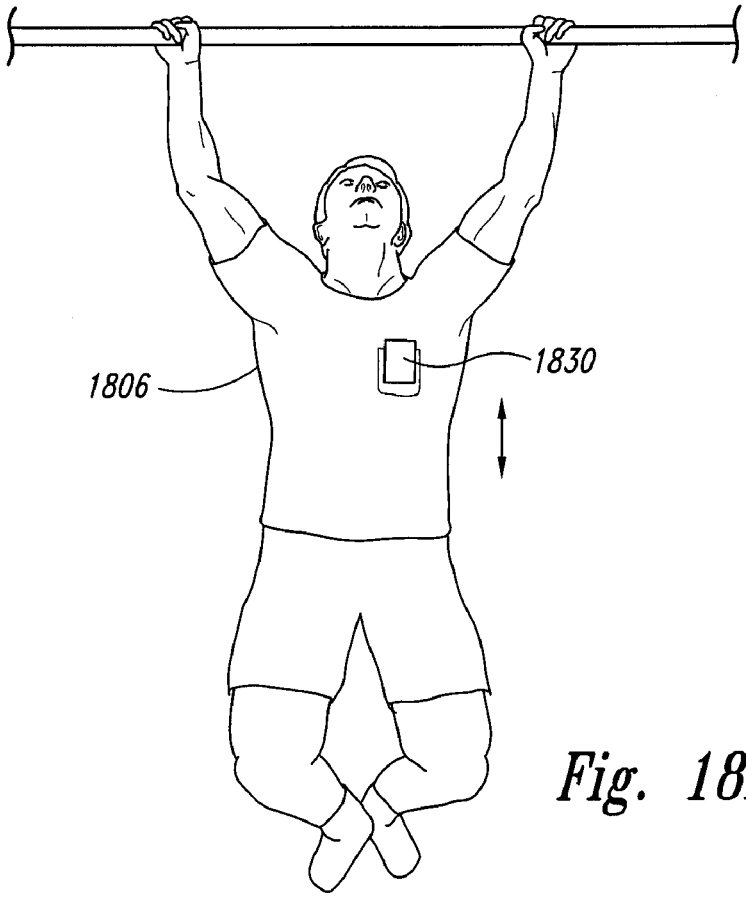

FIGS. 18A and 18B show a user 1806 doing sit-ups and chin-ups, respectively, with a data acquisition module 1830 configured in accordance with another embodiment of the invention. In FIG. 18A, the user 1806 wears the data acquisition module 1830 on a wristband 1808. In FIG. 18B, the user 1806 carries the data acquisition module 1830 in or on a pocket of his shirt. In other embodiments, the user 1806 can carry the data acquisition module 1830 in other ways to record repetitive movements during exercise.

In the illustrated embodiment, the data acquisition module 1830 can be at least generally similar in structure and function to the data acquisition module 230 described in detail above with reference FIGS. 2 and 7. In this regard, the data acquisition module 1830 can include an accelerometer, a processor, memory, a power source, etc. to detect and record the repetitive motions of the user 1806 during various forms of exercise.

Figure 18C:
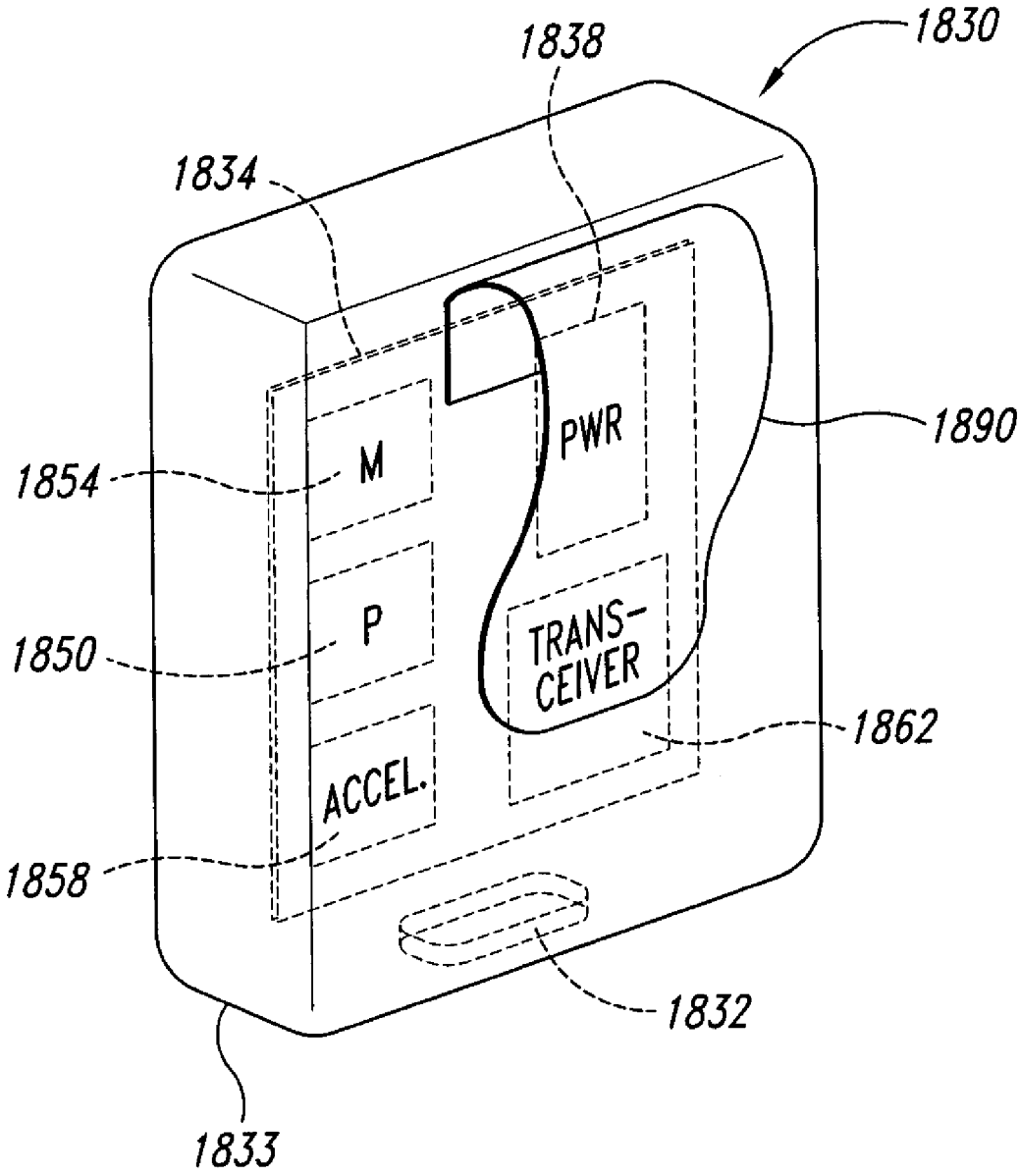
FIG. 18C is an enlarged, partially hidden isometric view of the data acquisition module shown in FIGS. 18A and 18B.

FIG. 18C is an enlarged, partially hidden isometric view of the data acquisition module 1830 shown in FIGS. 18A and 18B. As mentioned above, many features of the data acquisition module 1830 can be at least generally similar in structure and function to corresponding features of the data acquisition module 230 described above with reference to FIGS. 2 and 7. For example, the data acquisition module can include electronic circuitry 1834 contained within a pocket-sized housing 1833. The electronic circuitry 1834 can include an accelerometer 1858 and a processor 1850 operably connected to a power source 1838. The accelerometer 1858 can detect motion of the user during an exercise set, and provide this information to the processor 1850. The processor 1850 can be configured to determine the number of repetitions of the exercise based on the information from the accelerometer 1858, as explained above with reference to, e.g., FIG. 8A. The processor 1850 can store this information in memory 1854 for later download to a user computer or other suitable display device for viewing by the user.

In another aspect of this embodiment, the data acquisition module 1830 can include an electronic interface 1832 for downloading information from the memory 1854 to a user computer or other suitable display device. In one embodiment, the electronic interface 1832 can include a USB port or other suitable electronic interface known in the art. In other embodiments, the data acquisition module 1830 can include a transceiver 1862 for wirelessly communicating information to, or receiving information from, a user computer or other suitable display device, and/or another type of remote processing device (e.g. a machine information unit, such as the machine information unit 1020 of FIG. 10). In addition to the foregoing features, the data acquisition module 1830 can also include a clip 1890 or other attachment feature (e.g., Velcro, a flexible band or strap, etc.) for releasably securing the data acquisition module 1830 to a pocket, belt, or other article of clothing (e.g., a wristband) worn by the user.

The data acquisition module 1830 can be used in at least two different modes in accordance with the present invention. In the first mode, the data acquisition module 1830 can be attached to (or carried by) the user 1806, and used as shown in FIGS. 18A and 18B to record the number of repetitions of callisthenic-type exercises (e.g., chin-ups, sit-ups, leg lifts, etc.) or free-weight exercises (e.g., curling, bench-press, flys, and other barbell exercises). In the second mode, the data acquisition module 1830 can be used in the manner described above for the data acquisition module 230. That is, the data acquisition module 1830 can be releasably coupled to an instrumented weight pin for use in the manner described above for the instrumented weight pin 110.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims

We claim:

1. A weight pin for use with a stacked weight exercise machine, the weight pin comprising:

a handle portion;

a shaft portion extending outwardly from the handle portion, wherein the shaft portion is configured to be removably positioned adjacent to one or more weights of the exercise machine to selectively engage the one or more weights during use of the exercise machine; and a load sensor carried by the shaft portion, wherein the load sensor is configured to respond to the weight of the one or more weights during use of the exercise machine.

2. The weight pin of claim 1 wherein the shaft portion is configured to be removably inserted beneath the one or more weights of the exercise machine to support the one or more weights during use of the exercise machine.

3. The weight pin of claim 1, further comprising an actuator operably carried by the shaft portion, wherein the load sensor is configured to respond to movement of the actuator during use of the exercise machine.

4. The weight pin of claim 1 wherein the shaft portion includes an outer surface, and wherein the weight pin further comprises an actuator having a bearing surface positioned adjacent to the outer surface, wherein the load sensor is configured to respond to movement of the bearing surface during use of the exercise machine.

5. The weight pin of claim 1 wherein the shaft portion includes a cylindrical surface configured to be removably inserted through a hole in a support member of the exercise machine to releasably couple the one or more weights to the support member during use of the exercise machine, and wherein the weight pin further comprises:

an actuator having a bearing surface positioned adjacent to the outer surface of the shaft portion, wherein the load sensor responds to movement of the bearing surface during use of the exercise machine; and a data acquisition module removably carried by the handle portion, the data acquisition module including:

a processor operably connected to the load sensor to process information from the load sensor; and memory operably connected to the processor to record information from the processor.

6. The weight pin of claim 5 wherein the bearing surface of the actuator is positioned to contact the support member of the exercise machine during use of the exercise machine.

7. A weight pin for use with a stacked weight exercise machine, the weight pin comprising:

a handle portion;

a shaft portion extending outwardly from the handle portion, wherein the shaft portion is configured to be removably positioned adjacent to one or more weights of the exercise machine to selectively engage the one or more weights during use of the exercise machine; and a load sensor carried by the shaft portion, wherein the load sensor is configured to be operably compressed by the one or more weights during use of the exercise machine.

8. A weight pin for use with a stacked weight exercise machine, the weight pin comprising:

a handle portion;

a shaft portion extending outwardly from the handle portion, wherein the shaft portion is configured to be removably positioned adjacent to one or more weights of the exercise machine to selectively engage the one or more weights during use of the exercise machine;

a load sensor carried by the shaft portion; and memory operably connected to the load sensor to store information received from the load sensor.

9. The weight pin of claim 8, further comprising:

a processor operably connected to the load sensor to process information from the load sensor, wherein the memory is operably connected to the processor to record information from the processor.

10. The weight pin of claim 9 wherein the memory includes computer-readable instructions causing the processor to determine an exercise weight associated with the use of the exercise machine based at least in part on the information received from the load sensor.

11. A weight pin for use with a stacked weight exercise machine, the weight pin comprising:

a handle portion;

a shaft portion extending outwardly from the handle portion, wherein the shaft portion is configured to be removably positioned adjacent to one or more weights of the exercise machine to selectively engage the one or more weights during use of the exercise machine;

a load sensor carried by the shaft portion; and an accelerometer configured to respond to movement of the one or more weights during use of the exercise machine.

12. A weight pin for use with a stacked weight exercise machine, the weight pin comprising:

a handle portion;

a shaft portion extending outwardly from the handle portion, wherein the shaft portion is configured to be removably positioned adjacent to one or more weights of the exercise machine to selectively engage the one or more weights during use of the exercise machine;

a load sensor carried by the shaft portion; and a data acquisition module operably connected to the load sensor, the data acquisition module including:

a processor operably connected to the load sensor to process information from the load sensor; and memory operably connected to the processor to record information from the processor.

13. The weight pin of claim 12 wherein the data acquisition module is removably attached to the handle portion.

14. The weight pin of claim 12 wherein the data acquisition module further includes an accelerometer operably connected to the processor and configured to respond to movement of the one or more weights during use of the exercise machine.

15. The weight pin of claim 12 wherein the data acquisition module further includes a receiver for receiving information associated with the exercise machine and transmitting the information to the memory.

16. The weight pin of claim 12 wherein the data acquisition module processor is a first processing device, and wherein the data acquisition module further includes a communication facility for transmitting information to a second processing device spaced apart from the weight pin.

17. The weight pin of claim 12 wherein the data acquisition module further includes a wireless receiver for receiving information associated with the exercise machine and transmitting the information to the memory.

18. A weight pin for use with a stacked weight exercise machine, the weight pin comprising:

a handle portion;

a shaft portion extending outwardly from the handle portion, wherein the shaft portion is configured to be removably positioned adjacent to one or more weights of the exercise machine to selectively engage the one or more weights during use of the exercise machine; and a load sensor carried by the shaft portion, wherein the load sensor includes a force sensor.

19. The weight pin of claim 18 wherein the shaft portion includes an outer surface, and wherein the force sensor is positioned adjacent to the outer surface.

20. The weight pin of claim 18 wherein the shaft portion includes an outer surface, and wherein the force sensor is bonded to the outer surface.

21. A weight pin for use with a stacked weight exercise machine, the weight pin comprising:

a handle portion;

a shaft portion extending outwardly from the handle portion, wherein the shaft portion is configured to be removably positioned adjacent to one or more weights of the exercise machine to selectively engage the one or more weights during use of the exercise machine; and an accelerometer, wherein the accelerometer is configured to respond to movement of the one or more weights during operation of the exercise machine.

22. The weight pin of claim 21 wherein the shaft portion is configured to be removably inserted beneath the one or more weights of the exercise machine to support the one or more weights during use of the exercise machine.

23. The weight pin of claim 21 wherein the accelerometer is carried by the handle portion of the pin.

24. The weight pin of claim 21, further comprising:

a processor operably connected to the accelerometer to process information from the accelerometer; and memory operably connected to the processor to record information from the processor.

25. The weight pin of claim 24 wherein at least the memory is removably attached to the handle portion of the pin.

26. The weight pin of claim 24, further comprising computer-readable instructions stored in the memory, the computer-readable instructions causing the processor to determine a number of repetitions associated with the use of the exercise machine based at least in part on the information received from the accelerometer.

27. An exercise machine pin, the exercise machine pin comprising:

a handle portion;

a shaft portion extendinc outwardly from the handle portion, wherein the shaft portion is configured to be removably positioned adjacent to one or more weights of an exercise machine to releasablv couple the one or more weights to a lifting portion of the exercise machine during use of the exercise machine; and a data receiver configured to receive information associated with the exercise machine, wherein the data receiver includes a wireless data receiver.

28. The exercise machine pin of claim 27 wherein the data receiver includes a radio frequency scanner.

29. The exercise machine pin of claim 27 wherein the data receiver includes a wireless transceiver configured to receive information from an RFID tag positioned at least proximate to the exercise machine.

* * * * *